US007281509B2

(12) United States Patent
Fukui et al.

(10) Patent No.: US 7,281,509 B2
(45) Date of Patent: Oct. 16, 2007

(54) INTERNAL COMBUSTION ENGINE SYSTEM AND STARTING METHOD OF INTERNAL COMBUSTION ENGINE

(75) Inventors: Keita Fukui, Toyota (JP); Keiko Hasegawa, Toyota (JP); Mamoru Tomatsuri, Toyota (JP); Naoto Suzuki, Fujinomiya (JP); Toshio Inoue, Gotenba (JP); Katsuhiko Yamaguchi, Nissin (JP)

(73) Assignee: Toyota Jidosha Kabushiki Kaisha, Toyota-shi (JP)

( * ) Notice: Subject to any disclaimer, the term of this patent is extended or adjusted under 35 U.S.C. 154(b) by 279 days.

(21) Appl. No.: 11/227,295

(22) Filed: Sep. 16, 2005

(65) Prior Publication Data

US 2006/0060162 A1 Mar. 23, 2006

(30) Foreign Application Priority Data

Sep. 17, 2004 (JP) ..... 2004-271848

(51) Int. Cl.
*F02D 41/06* (2006.01)
*F02D 9/02* (2006.01)
*F02D 13/02* (2006.01)

(52) U.S. Cl. ..... 123/179.16; 123/435

(58) Field of Classification Search ..... 123/179.16, 123/435

See application file for complete search history.

(56) References Cited

U.S. PATENT DOCUMENTS 6,216,664 B1 4/2001 Bochum et al.
6,236,931 B1 * 5/2001 Poggio et al. ..... 123/435
6,474,294 B2 * 11/2002 Yamazaki et al. ..... 123/179.4
7,047,945 B2 * 5/2006 Ishii et al. ..... 123/491
7,182,062 B2 * 2/2007 Beer et al. ..... 123/305
2001/0042535 A1 * 11/2001 Yamazaki et al. ..... 123/179.4
2002/0062813 A1 * 5/2002 Miyashita et al. ..... 123/179.16
2005/0087169 A1 * 4/2005 Yoshida et al. ..... 123/182.1
2005/0155568 A1 * 7/2005 Maitani ..... 123/295
2006/0144363 A1 * 7/2006 Beer et al. ..... 123/305

FOREIGN PATENT DOCUMENTS

DE 196 12 150 A1 10/1997
DE 197 46 119 A1 4/1999

(Continued)

*Primary Examiner*—Stephen K. Cronin
*Assistant Examiner*—Arnold Castro
(74) *Attorney, Agent, or Firm*—Kenyon & Kenyon LLP

(57) ABSTRACT

The start control procedure of the invention lags an open-close timing VVT of an intake valve, restricts a throttle opening TH of a throttle valve, and starts cranking an engine with a lower torque Tlow. When a pressure Pf of a fuel supplied to in-cylinder fuel injection valves reaches or exceeds a preset reference value, which is greater than a sum of an in-cylinder compression pressure Pin and a closed valve position-retaining pressure Pcv of the in-cylinder fuel injection valves, the start control procedure cranks the engine with a standard cranking torque Tset. The start control procedure then starts advance of the open-close timing VVT of the intake valve, cancels the restriction of the throttle opening TH, and starts fuel injection from the in-cylinder fuel injection valves. This arrangement enables the fuel pressure Pf to quickly rise to or above the sum of the in-cylinder compression pressure Pin and the closed valve position-retaining pressure Pcv, and thereby effectively prevents the in-cylinder fuel injection valves from being inadequately opened.

16 Claims, 10 Drawing Sheets

FOREIGN PATENT DOCUMENTS

| | | |
|---|---|---|
| DE | 100 52 344 A1 | 5/2002 |
| JP | 63-246442 | 10/1988 |
| JP | 04-086355 | 3/1992 |
| JP | 10-009032 | 1/1998 |
| JP | 10-176563 | 6/1998 |
| JP | 10-212983 | 8/1998 |
| JP | 11-270385 | 10/1999 |
| JP | 2000-064874 | 2/2000 |
| JP | 2001-303987 | 10/2001 |
| JP | 2001-336439 | 12/2001 |
| JP | 2002-130012 | 5/2002 |
| JP | 2002-180891 | 6/2002 |
| JP | 09-166039 | 6/2007 |

* cited by examiner

INTERNAL COMBUSTION ENGINE SYSTEM AND STARTING METHOD OF INTERNAL COMBUSTION ENGINE

BACKGROUND OF THE INVENTION

1. Field of the Invention

The present invention relates to an internal combustion engine system and a starting method of an internal combustion engine. More specifically the invention pertains to an internal combustion engine system including an internal combustion engine equipped with in-cylinder fuel injection valves for in-cylinder injection of a fuel, as well as to a starting method of the internal combustion engine in the internal combustion engine system.

2. Description of the Prior Art

A proposed internal combustion engine system includes an internal combustion engine equipped with in-cylinder fuel injection valves for direct in-cylinder injection of a fuel and intake port fuel injection valves for injection of the fuel in an intake port (see, for example, Japanese Patent Laid-Open Gazette No. H11-270385). At a start of the internal combustion engine, this prior art system prohibits fuel injection from the in-cylinder fuel injection valves until a rise of the pressure of the fuel supplied to the in-cylinder fuel injection valves (fuel pressure) to a preset reference level. The internal combustion engine starts with the fuel injected from the intake port fuel injection valves. This accelerates microparticulation of the fuel in the cylinders to improve the starting performance of the internal combustion engine and prevent the deterioration of emission. This prior art system stops fuel injection from the intake port fuel injection valves in response to the rise of the fuel pressure to the preset reference level and starts fuel injection from the in-cylinder fuel injection valves.

SUMMARY OF THE INVENTION

In the prior art internal combustion engine system, however, the inadequate setting of the reference level as the fuel pressure for starting fuel injection from the in-cylinder fuel injection valves may cause poor emission and a delayed start of fuel injection from the in-cylinder fuel injection valves. When the fuel pressure exceeds the preset reference level to start fuel injection from the in-cylinder fuel injection valves in the lower setting of the reference level or in an increase of the in-cylinder pressure in a combustion chamber to a high level by combustion of the fuel injected from the intake port fuel injection valves, the fuel pressure may be an insufficient level to keep the in-cylinder fuel injection valves in a closed position. This may inadequately open the in-cylinder fuel injection valves to cause leakage of the fuel and poor emission. The inadequate opening of the in-cylinder fuel injection valves may also cause potential troubles besides the poor emission, for example, the worsened sealing property by the back flow of the high-pressure gas and the clog of the in-cylinder fuel injection valves with deposit. The higher setting of the reference pressure, on the other hand, does not start fuel injection from the in-cylinder fuel injection valves, in spite of a sufficient rise in fuel pressure relative to the in-cylinder pressure in the compression process of the internal combustion engine. This undesirably lags a complete start of the internal combustion engine.

The internal combustion engine system and the internal combustion engine starting method of the invention aim to adequately start an internal combustion engine equipped with an in-cylinder fuel injection valve for in-cylinder injection of a fuel. The internal combustion engine system and the internal combustion engine starting method of the invention also aim to prevent an in-cylinder fuel injection valve from being inadequately opened at a start of an internal combustion engine equipped with the in-cylinder fuel injection valve for in-cylinder injection of a fuel. The internal combustion engine system and the internal combustion engine starting method of the invention further aim to quickly start an internal combustion engine equipped with an in-cylinder fuel injection valve for in-cylinder injection of a fuel.

In order to attain at least part of the above and the other related objects, the internal combustion engine system and the internal combustion engine starting method of the invention are configured as discussed below.

The present invention is directed to a first internal combustion engine system including an internal combustion engine that is equipped with an in-cylinder fuel injection valve for in-cylinder injection of a fuel. The first internal combustion engine system includes: a pressurization supply unit that pressurizes the fuel and supplies the pressurized fuel to the in-cylinder fuel injection valve at a start of the internal combustion engine; a fuel pressure measurement sensor that measures a pressure of the fuel supplied to the in-cylinder fuel injection valve; an in-cylinder compression pressure detection estimation module that either detects or estimates an in-cylinder compression pressure as an in-cylinder pressure in a compression process of the internal combustion engine; a cranking module that cranks the internal combustion engine; and a start control module that, in response to a start instruction of the internal combustion engine, controls the cranking module to crank the internal combustion engine, while controlling the in-cylinder fuel injection valve to start fuel injection from the in-cylinder fuel injection valve, after the fuel pressure measured by the fuel pressure measurement sensor reaches a preset first pressure, which is determined according to the in-cylinder compression pressure either detected or estimated by the in-cylinder compression pressure detection estimation module and a closed valve position-retaining pressure for keeping the in-cylinder fuel injection valve in a closed position.

In response to a start instruction of the internal combustion engine, the first internal combustion engine system of the invention controls the cranking module to crank the internal combustion engine, while controlling the in-cylinder fuel injection valve to start fuel injection from the in-cylinder fuel injection valve, after the pressure of the fuel supplied to the in-cylinder fuel injection valve reaches the preset first pressure, which is determined according to the in-cylinder compression pressure detected or estimated as the in-cylinder pressure in the compression process of the internal combustion engine and the closed valve position-retaining pressure for keeping the in-cylinder fuel injection valve in the closed position. Namely fuel injection from the in-cylinder fuel injection valve starts after the pressure of the fuel supplied to the in-cylinder fuel injection valve reaches the preset first pressure that ensures no undesirable opening of the in-cylinder fuel injection valve. This arrangement effectively restrains the in-cylinder fuel injection valve from being inadequately opened and thereby prevents potential troubles caused by the inadequate opening of the in-cylinder fuel injection valve, for example, the poorer emission, the worsened sealing property, and the clog of the in-cylinder fuel injection valve with deposit. Fuel injection from the in-cylinder fuel injection valve starts immediately after the rise in pressure of the fuel supplied to the in-cylinder fuel injection valve to the preset first pressure. This ensures a quick and adequate start of the internal combustion engine. The first internal combustion engine system of the invention may be mounted as one of driving sources on an automobile.

In the first internal combustion engine system of the invention, it is preferable that the start control module is activated in response to a first start instruction of the internal combustion engine after activation of the internal combustion engine system. In the system with the auto start and stop functions of the internal combustion engine in a short time period, the pressure of the fuel supplied to the in-cylinder fuel injection valve is kept in a certain range even at an auto stop of the internal combustion engine. At a next auto start of the internal combustion engine after the auto stop, the fuel pressure is still greater than the preset first pressure and does not require the control by the start control module. At a first start of the internal combustion engine after the system activation, however, the fuel pressure is generally lowered below the preset first pressure. The control by the start control module is thus required for an adequate start of the internal combustion engine.

In one preferable embodiment of the invention, the first internal combustion engine system may further include an intake-system fuel injection valve that injects the fuel into an air intake system of the internal combustion engine. The start control module may regulate an amount of intake-system fuel injection to make the intake-system fuel injection valve start fuel injection, prior to a start of fuel injection from the in-cylinder fuel injection valve. Combustion of the fuel injected from the intake-system fuel injection valve ensures a quicker start of the internal combustion engine.

In another preferable embodiment of the invention, the first internal combustion engine system may further include an open-close timing varying mechanism that varies an open-close timing of an intake valve of the internal combustion engine. The start control module may control the open-close timing varying mechanism and the cranking module to set the open-close timing of the intake valve to a first timing for facilitating the cranking and to crank the internal combustion engine at the first timing set to the open-close timing. The start control module may control the open-close timing varying mechanism to initiate a timing change that gradually varies the open-close timing of the intake valve to earlier timing than the first timing, after the measured fuel pressure reaches a preset second pressure that is not higher than the preset first pressure, which is determined according to the detected or estimated in-cylinder compression pressure and the closed valve position-retaining pressure of the in-cylinder fuel injection valve. The change of the open-close timing of the intake valve from the first timing for facilitating the engine cranking to the earlier timing increases the in-cylinder compression pressure. The timing change after the rise of the fuel pressure to or above the preset second pressure controls the increase rate of the in-cylinder compression pressure and thereby accelerates the rise of the fuel pressure to the preset first pressure. This ensures a quicker start of the internal combustion engine.

In one preferable application of the first internal combustion engine system of the invention, the start control module may control a throttle valve to decrease an amount of air intake to the internal combustion engine below a standard level of air intake, until the measured fuel pressure reaches a preset third pressure that is not higher than the preset first pressure, which is determined according to the detected or estimated in-cylinder compression pressure and the closed valve position-retaining pressure of the in-cylinder fuel injection valve. The start control module may control the throttle valve to restore the amount of air intake to the internal combustion engine to the standard level of air intake after the measured fuel pressure reaches the preset third pressure. The variation in amount of air intake directly affects the variation of the in-cylinder compression pressure. The decreased amount of air intake thus slows down the increase of the in-cylinder compression pressure and accelerates the rise of the fuel pressure to the preset first pressure. This ensures a quicker start of the internal combustion engine.

In another preferable application of the first internal combustion engine system of the invention, the start control module may control the cranking module to crank the internal combustion engine with a preset driving force smaller than a standard level of driving force, until the measured fuel pressure reaches a preset fourth pressure that is not higher than the preset first pressure, which is determined according to the detected or estimated in-cylinder compression pressure and the closed valve position-retaining pressure of the in-cylinder fuel injection valve. The start control module may control the cranking module to crank the internal combustion engine with the standard level of driving force after the measured fuel pressure reaches the preset fourth pressure. The variation in driving force used for cranking affects the increase rate of the rotation speed of the internal combustion engine and accordingly the increase rate of the in-cylinder fuel injection valve. The smaller driving force used for cranking thus slows down the increase of the in-cylinder compression pressure and accelerates the rise of the fuel pressure to the preset first pressure. This ensures a quicker start of the internal combustion engine.

The present invention is also directed to a second internal combustion engine system including an internal combustion engine that is equipped with an in-cylinder fuel injection valve for in-cylinder injection of a fuel. The second internal combustion engine system includes: a pressurization supply unit that pressurizes the fuel and supplies the pressurized fuel to the in-cylinder fuel injection valve at a start of the internal combustion engine; a fuel pressure measurement sensor that measures a pressure of the fuel supplied to the in-cylinder fuel injection valve; an in-cylinder compression pressure detection estimation module that either detects or estimates an in-cylinder compression pressure as an in-cylinder pressure in a compression process of the internal combustion engine; a cranking module that cranks the internal combustion engine; an open-close timing varying mechanism that varies an open-close timing of an intake valve of the internal combustion engine; and a start control module that, in response to a start instruction of the internal combustion engine, controls the open-close timing varying mechanism and the cranking module to set the open-close timing of the intake valve to a first timing for facilitating the cranking and to crank the internal combustion engine at the first timing set to the open-close timing, and the start control module controlling the open-close timing varying mechanism to initiate a timing change that gradually varies the open-close timing of the intake valve to earlier timing than the first timing, after the fuel pressure measured by the fuel pressure measurement sensor reaches an adaptive pressure, which is determined according to the in-cylinder compression pressure either detected or estimated by the in-cylinder compression pressure detection estimation module and a closed valve position-retaining pressure for keeping the in-cylinder fuel injection valve in a closed position, and the start control module controlling the in-cylinder fuel injection valve to start fuel injection from the in-cylinder fuel injection valve at a preset timing.

In response to a start instruction of the internal combustion engine, the second internal combustion engine system of the invention controls the open-close timing varying mechanism and the cranking module to set the open-close timing of the intake valve to the first timing for facilitating the engine cranking and to crank the internal combustion engine at the first timing set to the open-close timing. The second internal combustion engine system controls the open-close timing varying mechanism to initiate the timing change that gradually varies the open-close timing of the intake valve to the earlier timing than the first timing, after the pressure of the fuel supplied to the in-cylinder fuel injection valve reaches the adaptive pressure, which is determined according to the in-cylinder compression pressure detected or estimated as the in-cylinder pressure in the compression process of the internal combustion engine and the closed valve position-retaining pressure for keeping the in-cylinder fuel injection valve in the closed position. The second internal combustion engine system controls the in-cylinder fuel injection valve to start fuel injection from the in-cylinder fuel injection valve at the preset timing. The change of the open-close timing of the intake valve from the first timing for facilitating the engine cranking to the earlier timing increases the in-cylinder compression pressure. The timing change after the rise of the fuel pressure to the adaptive pressure, which depends upon the in-cylinder compression pressure and the closed valve position-retaining pressure, slows down the increase of the in-cylinder compression pressure, compared with the increase of the fuel pressure. This accelerates the rise of the fuel pressure to the adaptive pressure and thus ensures a quick start of the internal combustion engine. Fuel injection from the in-cylinder fuel injection valve starts at the preset timing. It is thus preferable that the preset timing comes after the rise of the fuel pressure to a greater pressure than the adaptive pressure. This arrangement effectively restrains the in-cylinder fuel injection valve from being inadequately opened and thereby prevents potential troubles caused by the inadequate opening of the in-cylinder fuel injection valve, for example, the poorer emission, the worsened sealing property, and the clog of the in-cylinder fuel injection valve with deposit. The second internal combustion engine system of the invention may be mounted as one of driving sources on an automobile.

The present invention is also directed to a third internal combustion engine system including an internal combustion engine that is equipped with an in-cylinder fuel injection valve for in-cylinder injection of a fuel. The third internal combustion engine system includes: a pressurization supply unit that pressurizes the fuel and supplies the pressurized fuel to the in-cylinder fuel injection valve at a start of the internal combustion engine; a fuel pressure measurement sensor that measures a pressure of the fuel supplied to the in-cylinder fuel injection valve; an in-cylinder compression pressure detection estimation module that either detects or estimates an in-cylinder compression pressure as an in-cylinder pressure in a compression process of the internal combustion engine; a cranking module that cranks the internal combustion engine; and a start control module that, in response to a start instruction of the internal combustion engine, controls the cranking module to crank the internal combustion engine, and the start control module controlling a throttle valve to decrease an amount of air intake to the internal combustion engine below a standard level of air intake, until the fuel pressure measured by the fuel pressure measurement sensor reaches an adaptive pressure, which is determined according to the in-cylinder compression pressure either detected or estimated by the in-cylinder compression pressure detection estimation module and a closed valve position-retaining pressure for keeping the in-cylinder fuel injection valve in a closed position, and the start control module controlling the throttle valve to restore the amount of air intake to the internal combustion engine to the standard level of air intake after the measured fuel pressure reaches the adaptive pressure, and the start control module controlling the in-cylinder fuel injection valve to start fuel injection from the in-cylinder fuel injection valve at a preset timing.

In response to a start instruction of the internal combustion engine, the third internal combustion engine system of the invention controls the cranking module to crank the internal combustion engine. The third internal combustion engine system controls the throttle valve to decrease the amount of air intake to the internal combustion engine below the standard level of air intake, until the pressure of the fuel supplied to the in-cylinder fuel injection valve reaches the adaptive pressure, which is determined according to the in-cylinder compression pressure detected or estimated as the in-cylinder pressure in the compression process of the internal combustion engine and the closed valve position-retaining pressure for keeping the in-cylinder fuel injection valve in the closed position. The third internal combustion engine system controls the throttle valve to restore the amount of air intake to the internal combustion engine to the standard level of air intake after the fuel pressure reaches the adaptive pressure. The third internal combustion engine system controls the in-cylinder fuel injection valve to start fuel injection from the in-cylinder fuel injection valve at the preset timing. The variation in amount of air intake directly affects the variation of the in-cylinder compression pressure. The decreased amount of air intake thus slows down the increase of the in-cylinder compression pressure. The decreased amount of air intake until the rise of the fuel pressure to the adaptive pressure, which depends upon the in-cylinder compression pressure and the closed valve position-retaining pressure, slows down the increase of the in-cylinder compression pressure, compared with the increase of the fuel pressure. This accelerates the rise of the fuel pressure to the adaptive pressure and thus ensures a quick start of the internal combustion engine. Fuel injection from the in-cylinder fuel injection valve starts at the preset timing. It is thus preferable that the preset timing comes after the rise of the fuel pressure to a greater pressure than the adaptive pressure. This arrangement effectively restrains the in-cylinder fuel injection valve from being inadequately opened and thereby prevents potential troubles caused by the inadequate opening of the in-cylinder fuel injection valve, for example, the poorer emission, the worsened sealing property, and the clog of the in-cylinder fuel injection valve with deposit. The third internal combustion engine system of the invention may be mounted as one of driving sources on an automobile.

The present invention is also directed to a fourth internal combustion engine system including an internal combustion engine that is equipped with an in-cylinder fuel injection valve for in-cylinder injection of a fuel. The fourth internal combustion engine system includes: a pressurization supply unit that pressurizes the fuel and supplies the pressurized fuel to the in-cylinder fuel injection valve at a start of the internal combustion engine; a fuel pressure measurement sensor that measures a pressure of the fuel supplied to the in-cylinder fuel injection valve; an in-cylinder compression pressure detection estimation module that either detects or estimates an in-cylinder compression pressure as an in-cylinder pressure in a compression process of the internal combustion engine; a cranking module that cranks the internal combustion engine; and a start control module that, in response to a start instruction of the internal combustion engine, controls the cranking module to crank the internal combustion engine with a preset first driving force, until the fuel pressure measured by the fuel pressure measurement sensor reaches an adaptive pressure, which is determined according to the in-cylinder compression pressure either detected or estimated by the in-cylinder compression pressure detection estimation module and a closed valve position-retaining pressure for keeping the in-cylinder fuel injection valve in a closed position, and the start control module controlling the cranking module to crank the internal combustion engine with a greater driving force than the preset first driving force after the measured fuel pressure reaches the adaptive pressure, and the start control module controlling the in-cylinder fuel injection valve to start fuel injection from the in-cylinder fuel injection valve at a preset timing.

In response to a start instruction of the internal combustion engine, the fourth internal combustion engine system of the invention controls the cranking module to crank the internal combustion engine with the preset first driving force, until the pressure of the fuel supplied to the in-cylinder fuel injection valve reaches the adaptive pressure, which is determined according to the in-cylinder compression pressure detected or estimated as the in-cylinder pressure in the compression process of the internal combustion engine and the closed valve position-retaining pressure for keeping the in-cylinder fuel injection valve in the closed position. The fourth internal combustion engine system controls the cranking module to crank the internal combustion engine with the greater driving force than the preset first driving force after the fuel pressure reaches the adaptive pressure. The fourth internal combustion engine system controls the in-cylinder fuel injection valve to start fuel injection from the in-cylinder fuel injection valve at the preset timing. The variation in driving force used for cranking affects the increase rate of the rotation speed of the internal combustion engine and accordingly the increase rate of the in-cylinder fuel injection valve. Cranking of the internal combustion engine with the smaller first driving force until the rise of the fuel pressure to the adaptive pressure, which depends upon the in-cylinder compression pressure and the closed valve position-retaining pressure, slows down the increase of the in-cylinder compression pressure, compared with the increase of the fuel pressure. This accelerates the rise of the fuel pressure to the adaptive pressure and thus ensures a quick start of the internal combustion engine. Fuel injection from the in-cylinder fuel injection valve starts at the preset timing. It is thus preferable that the preset timing comes after the rise of the fuel pressure to a greater pressure than the adaptive pressure. This arrangement effectively restrains the in-cylinder fuel injection valve from being inadequately opened and thereby prevents potential troubles caused by the inadequate opening of the in-cylinder fuel injection valve, for example, the poorer emission, the worsened sealing property, and the clog of the in-cylinder fuel injection valve with deposit. The fourth internal combustion engine system of the invention may be mounted as one of driving sources on an automobile.

The present invention is also directed to a first starting method of an internal combustion engine in an internal combustion engine system. The internal combustion engine system includes the internal combustion engine that is equipped with an in-cylinder fuel injection valve for in-cylinder injection of a fuel, a pressurization supply unit that pressurizes the fuel and supplies the pressurized fuel to the in-cylinder fuel injection valve at a start of the internal combustion engine, and a cranking module that cranks the internal combustion engine. The first starting method includes the steps of: controlling the cranking module to crank the internal combustion engine; and controlling the in-cylinder fuel injection valve to start fuel injection from the in-cylinder fuel injection valve, after a pressure of the fuel supplied to the in-cylinder fuel injection valve reaches an adaptive pressure, which is determined according to an in-cylinder compression pressure as an in-cylinder pressure in a compression process of the internal combustion engine and a closed valve position-retaining pressure for keeping the in-cylinder fuel injection valve in a closed position.

The first starting method of the internal combustion engine of the invention controls the cranking module to crank the internal combustion engine, while controlling the in-cylinder fuel injection valve to start fuel injection from the in-cylinder fuel injection valve, after the pressure of the fuel supplied to the in-cylinder fuel injection valve reaches the adaptive pressure, which is determined according to the in-cylinder compression pressure as the in-cylinder pressure in the compression process of the internal combustion engine and the closed valve position-retaining pressure for keeping the in-cylinder fuel injection valve in the closed position. Namely fuel injection from the in-cylinder fuel injection valve starts after the pressure of the fuel supplied to the in-cylinder fuel injection valve reaches the adaptive pressure that ensures no undesirable opening of the in-cylinder fuel injection valve. This arrangement effectively restrains the in-cylinder fuel injection valve from being inadequately opened and thereby prevents potential troubles caused by the inadequate opening of the in-cylinder fuel injection valve, for example, the poorer emission, the worsened sealing property, and the clog of the in-cylinder fuel injection valve with deposit. Fuel injection from the in-cylinder fuel injection valve starts immediately after the rise in pressure of the fuel supplied to the in-cylinder fuel injection valve to the adaptive pressure. This ensures a quick and adequate start of the internal combustion engine.

The present invention is also directed to a second starting method of an internal combustion engine in an internal combustion engine system. The internal combustion engine system includes the internal combustion engine that is equipped with an in-cylinder fuel injection valve for in-cylinder injection of a fuel, a pressurization supply unit that pressurizes the fuel and supplies the pressurized fuel to the in-cylinder fuel injection valve at a start of the internal combustion engine, a cranking module that cranks the internal combustion engine, and an open-close timing varying mechanism that varies an open-close timing of an intake valve of the internal combustion engine. The second starting method includes the steps of: controlling the open-close timing varying mechanism and the cranking module to set the open-close timing of the intake valve to a first timing for facilitating the cranking and to crank the internal combustion engine at the first timing set to the open-close timing; controlling the open-close timing varying mechanism to initiate a timing change that gradually varies the open-close timing of the intake valve to earlier timing than the first timing, after a pressure of the fuel supplied to the in-cylinder fuel injection valve reaches an adaptive pressure, which is determined according to an in-cylinder compression pressure as an in-cylinder pressure in a compression process of the internal combustion engine and a closed valve position-retaining pressure for keeping the in-cylinder fuel injection valve in a closed position; and controlling the in-cylinder fuel injection valve to start fuel injection from the in-cylinder fuel injection valve at a preset timing.

The second starting method of the internal combustion engine of the invention controls the open-close timing varying mechanism and the cranking module to set the open-close timing of the intake valve to the first timing for facilitating the engine cranking and to crank the internal combustion engine at the first timing set to the open-close timing. The second starting method controls the open-close timing varying mechanism to initiate the timing change that gradually varies the open-close timing of the intake valve to the earlier timing than the first timing, after the pressure of the fuel supplied to the in-cylinder fuel injection valve reaches the adaptive pressure, which is determined according to the in-cylinder compression pressure as the in-cylinder pressure in the compression process of the internal combustion engine and the closed valve position-retaining pressure for keeping the in-cylinder fuel injection valve in the closed position. The second starting method controls the in-cylinder fuel injection valve to start fuel injection from the in-cylinder fuel injection valve at the preset timing. The change of the open-close timing of the intake valve from the first timing for facilitating the engine cranking to the earlier timing increases the in-cylinder compression pressure. The timing change after the rise of the fuel pressure to the adaptive pressure, which depends upon the in-cylinder compression pressure and the closed valve position-retaining pressure, slows down the increase of the in-cylinder compression pressure, compared with the increase of the fuel pressure. This accelerates the rise of the fuel pressure to the adaptive pressure and thus ensures a quick start of the internal combustion engine. Fuel injection from the in-cylinder fuel injection valve starts at the preset timing. It is thus preferable that the preset timing comes after the rise of the fuel pressure to a greater pressure than the adaptive pressure. This arrangement effectively restrains the in-cylinder fuel injection valve from being inadequately opened and thereby prevents potential troubles caused by the inadequate opening of the in-cylinder fuel injection valve, for example, the poorer emission, the worsened sealing property, and the clog of the in-cylinder fuel injection valve with deposit.

The present invention is also directed to a third starting method of an internal combustion engine in an internal combustion engine system. The internal combustion engine system includes the internal combustion engine that is equipped with an in-cylinder fuel injection valve for in-cylinder injection of a fuel, a pressurization supply unit that pressurizes the fuel and supplies the pressurized fuel to the in-cylinder fuel injection valve at a start of the internal combustion engine, and a cranking module that cranks the internal combustion engine. The third starting method includes the steps of: controlling the cranking module to crank the internal combustion engine; controlling a throttle valve to decrease an amount of air intake to the internal combustion engine below a standard level of air intake, until a pressure of the fuel supplied to the in-cylinder fuel injection valve reaches an adaptive pressure, which is determined according to an in-cylinder compression pressure as an in-cylinder pressure in a compression process of the internal combustion engine and a closed valve position-retaining pressure for keeping the in-cylinder fuel injection valve in a closed position; controlling the throttle valve to restore the amount of air intake to the internal combustion engine to the standard level of air intake after the fuel pressure reaches the adaptive pressure; and controlling the in-cylinder fuel injection valve to start fuel injection from the in-cylinder fuel injection valve at a preset timing.

The third starting method of the internal combustion engine of the invention controls the cranking module to crank the internal combustion engine. The third starting method controls the throttle valve to decrease the amount of air intake to the internal combustion engine below the standard level of air intake, until the pressure of the fuel supplied to the in-cylinder fuel injection valve reaches the adaptive pressure, which is determined according to the in-cylinder compression pressure as the in-cylinder pressure in the compression process of the internal combustion engine and the closed valve position-retaining pressure for keeping the in-cylinder fuel injection valve in the closed position. The third starting method controls the throttle valve to restore the amount of air intake to the internal combustion engine to the standard level of air intake after the fuel pressure reaches the adaptive pressure. The third starting method controls the in-cylinder fuel injection valve to start fuel injection from the in-cylinder fuel injection valve at the preset timing. The variation in amount of air intake directly affects the variation of the in-cylinder compression pressure. The decreased amount of air intake thus slows down the increase of the in-cylinder compression pressure. The decreased amount of air intake until the rise of the fuel pressure to the adaptive pressure, which depends upon the in-cylinder compression pressure and the closed valve position-retaining pressure, slows down the increase of the in-cylinder compression pressure, compared with the increase of the fuel pressure. This accelerates the rise of the fuel pressure to the adaptive pressure and thus ensures a quick start of the internal combustion engine. Fuel injection from the in-cylinder fuel injection valve starts at the preset timing. It is thus preferable that the preset timing comes after the rise of the fuel pressure to a greater pressure than the adaptive pressure. This arrangement effectively restrains the in-cylinder fuel injection valve from being inadequately opened and thereby prevents potential troubles caused by the inadequate opening of the in-cylinder fuel injection valve, for example, the poorer emission, the worsened sealing property, and the clog of the in-cylinder fuel injection valve with deposit.

The present invention is also directed to a fourth starting method of an internal combustion engine in an internal combustion engine system. The internal combustion engine system includes the internal combustion engine that is equipped with an in-cylinder fuel injection valve for in-cylinder injection of a fuel, a pressurization supply unit that pressurizes the fuel and supplies the pressurized fuel to the in-cylinder fuel injection valve at a start of the internal combustion engine, and a cranking module that cranks the internal combustion engine. The fourth starting method includes the steps of: controlling the cranking module to crank the internal combustion engine with a preset first driving force, until a pressure of the fuel supplied to the in-cylinder fuel injection valve reaches an adaptive pressure, which is determined according to an in-cylinder compression pressure as an in-cylinder pressure in a compression process of the internal combustion engine and a closed valve position-retaining pressure for keeping the in-cylinder fuel injection valve in a closed position; controlling the cranking module to crank the internal combustion engine with a greater driving force than the preset first driving force after the fuel pressure reaches the adaptive pressure; and controlling the in-cylinder fuel injection valve to start fuel injection from the in-cylinder fuel injection valve at a preset timing.

The fourth starting method of the internal combustion engine of the invention controls the cranking module to crank the internal combustion engine with the preset first driving force, until the pressure of the fuel supplied to the in-cylinder fuel injection valve reaches the adaptive pressure, which is determined according to the in-cylinder compression pressure as the in-cylinder pressure in the compression process of the internal combustion engine and the closed valve position-retaining pressure for keeping the in-cylinder fuel injection valve in the closed position. The fourth starting method controls the cranking module to crank the internal combustion engine with the greater driving force than the preset first driving force after the fuel pressure reaches the adaptive pressure. The fourth starting method controls the in-cylinder fuel injection valve to start fuel injection from the in-cylinder fuel injection valve at the preset timing. The variation in driving force used for cranking affects the increase rate of the rotation speed of the internal combustion engine and accordingly the increase rate of the in-cylinder fuel injection valve. Cranking of the internal combustion engine with the smaller first driving force until the rise of the fuel pressure to the adaptive pressure, which depends upon the in-cylinder compression pressure and the closed valve position-retaining pressure, slows down the increase of the in-cylinder compression pressure, compared with the increase of the fuel pressure. This accelerates the rise of the fuel pressure to the adaptive pressure and thus ensures a quick start of the internal combustion engine. Fuel injection from the in-cylinder fuel injection valve starts at the preset timing. It is thus preferable that the preset timing comes after the rise of the fuel pressure to a greater pressure than the adaptive pressure. This arrangement effectively restrains the in-cylinder fuel injection valve from being inadequately opened and thereby prevents potential troubles caused by the inadequate opening of the in-cylinder fuel injection valve, for example, the poorer emission, the worsened sealing property, and the clog of the in-cylinder fuel injection valve with deposit.

DESCRIPTION OF THE PREFERRED EMBODIMENTS

Figure 1:
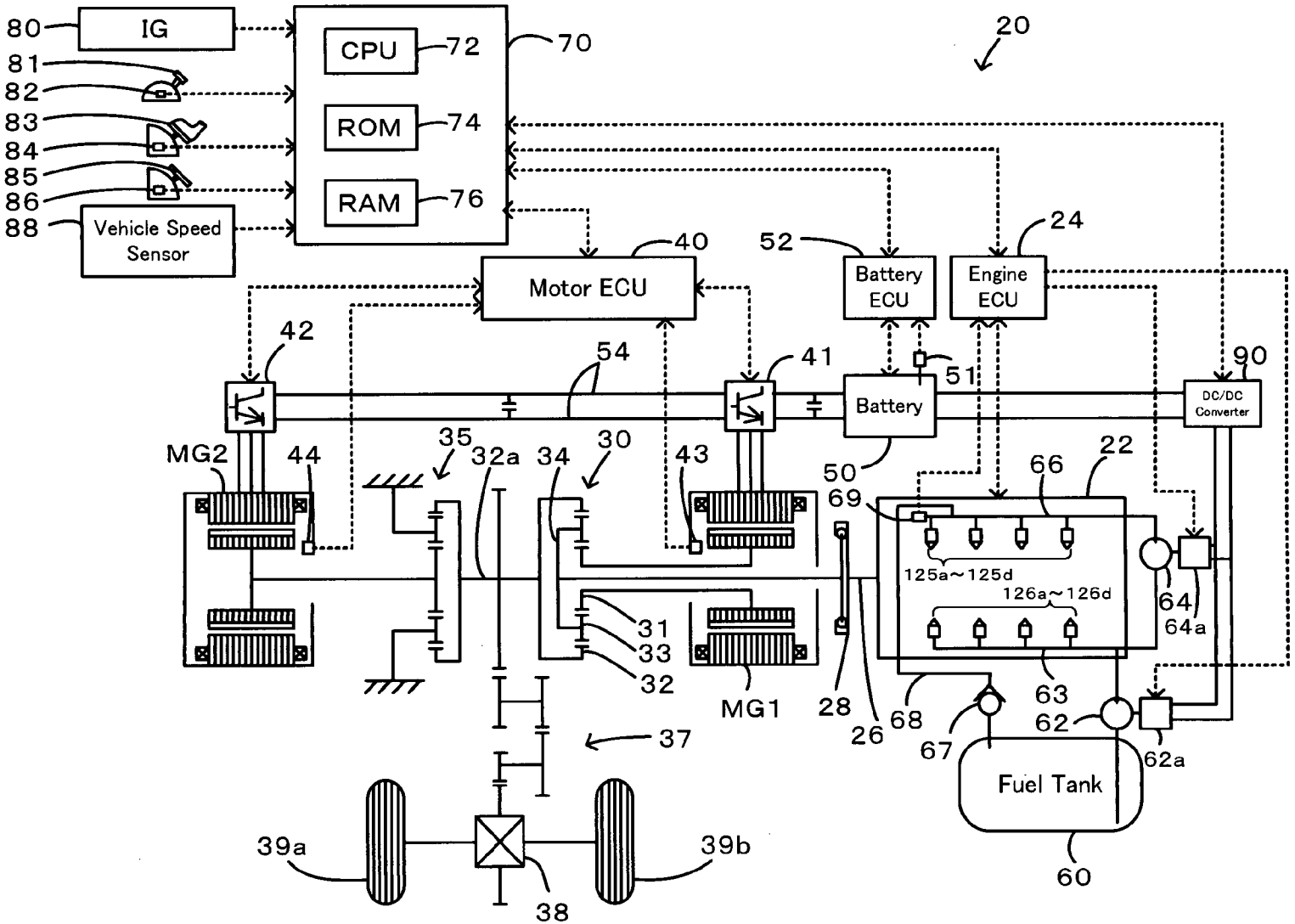
FIG. 1 schematically illustrates the configuration of a hybrid vehicle with an internal combustion engine system mounted thereon in one embodiment of the invention.

One mode of carrying out the invention is described as a preferred embodiment. FIG. 1 schematically illustrates the configuration of a hybrid vehicle 20 with an internal combustion engine system mounted thereon in one embodiment of the invention. As illustrated, the hybrid vehicle 20 of the embodiment includes an engine 22 and a power distribution integration mechanism 30. In the power distribution integration mechanism 30, a carrier 34 for coupling multiple pinion gears 33 is linked to a crankshaft 26 or an output shaft of the engine 22 via a damper 28, whereas a ring gear shaft 32*a* coupled with a ring gear 32 is linked to drive wheels 39*a* and 39*b* via a gear mechanism 37 and a differential gear 38. The hybrid vehicle 20 also includes a motor MG1 that is connected to a sun gear 31 of the power distribution integration mechanism 30 and is capable of generating electric power, a motor MG2 that is linked to the ring gear shaft 32 of the power distribution integration mechanism 30 via the ring gear shaft 32*a* and a reduction gear 35, and a hybrid electronic control unit 70 that controls the whole hybrid vehicle 20.

Figure 2:
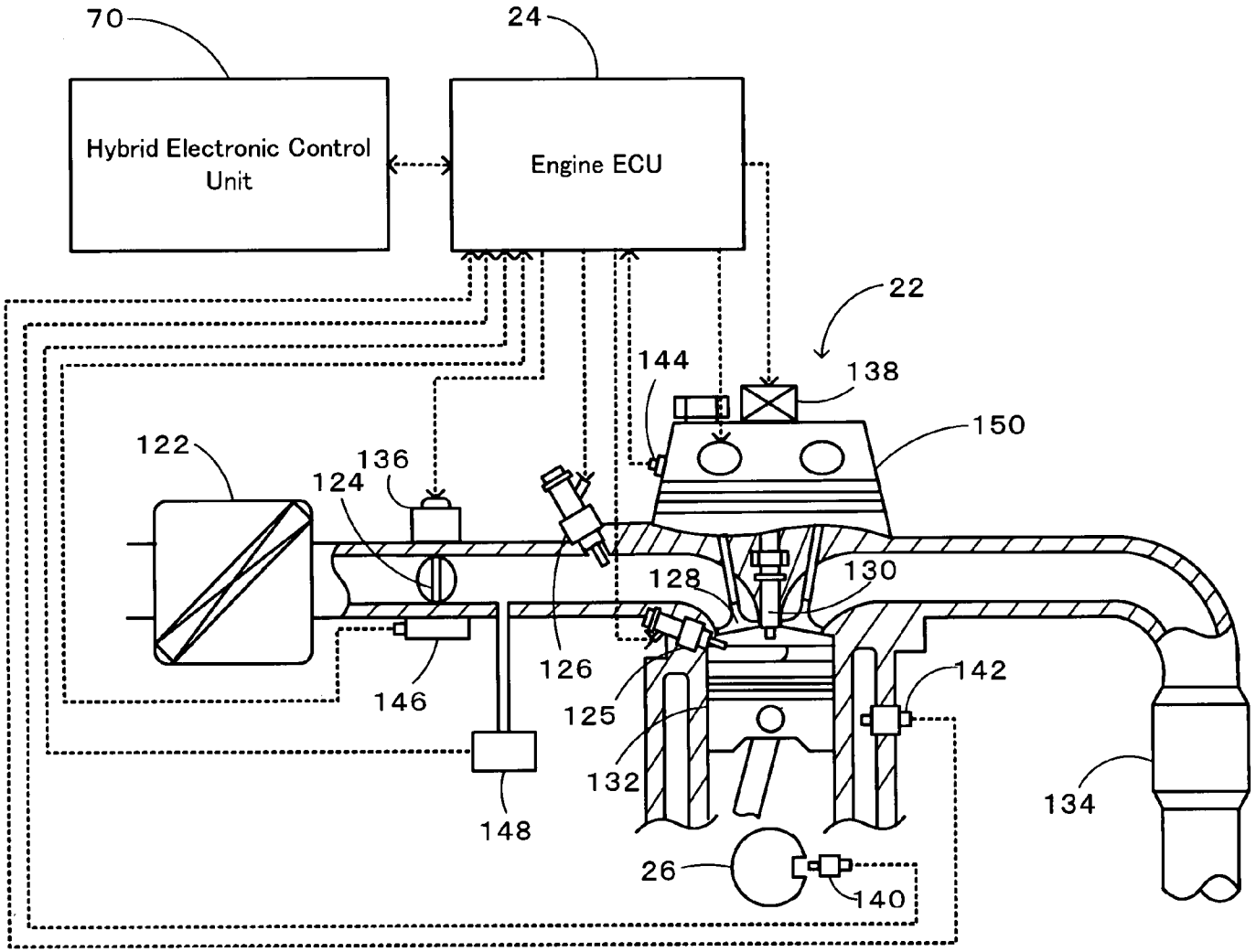
FIG. 2 schematically illustrates the structure of an engine mounted on the hybrid vehicle of the embodiment.

As shown in FIG. 2, the engine 22 is an internal combustion engine having in-cylinder fuel injection valves 125 (125*a* to 125*d* in FIG. 1) to directly inject a hydrocarbon fuel, for example, gasoline or light oil, into cylinders and port fuel injection valves 126 (126*a* to 126*d* in FIG. 1) to inject the hydrocarbon fuel into an air intake port. The engine 22 with the two different types of the fuel injection valves 125 and 126 is driven and controlled in a drive mode selected among a port injection drive mode, an in-cylinder injection drive mode, and a common injection drive mode. In the port injection drive mode, the engine 22 receives a supply of the air cleaned by an air cleaner 122 and taken in via a throttle valve 124 and a supply of fuel (gasoline) injected from the port fuel injection valves 126 and mixes the air and the fuel to an air fuel mixture. The air fuel mixture is sucked into a combustion chamber via an intake valve 128 to be explosively combusted with electric spark produced by an ignition plug 130. The reciprocating motions of a piston 132 pressed down by the energy of the explosive combustion are converted into rotational motions of the crankshaft 26. In the in-cylinder injection drive mode, the intake air is mixed with the fuel injected from the in-cylinder fuel injection valves 125 in an air intake process or in a compression process. The air fuel mixture is explosively combusted in the combustion chamber with electric spark produced by the ignition plug 130 to attain the rotational motions of the crankshaft 26. In the common injection drive mode, the intake air is mixed with the fuel injected from the port fuel injection valves 126 and with the fuel injected from the in-cylinder fuel injection valves 125 in the air intake process or in the compression process. The air fuel mixture is explosively combusted in the combustion chamber with electric spark produced by the ignition plug 130 to attain the rotational motions of the crankshaft 26. The drive mode is selectively switched over among these three drive modes according to the actual driving conditions of the engine 22 and the target driving conditions demanded for the engine 22. The exhaust of the engine 22 is released to the atmosphere via a catalytic converter (three-way catalyst) 134 that converts toxic components of the exhaust, that is, carbon monoxide (CO), hydrocarbons (HC), and nitrogen oxides (NOx).

As shown in FIG. 1, the port fuel injection valves 126*a* to 126*d* receives a supply of the fuel, which is fed from a fuel tank 60 by a fuel pump 62, whereas the in-cylinder fuel injection valves 125*a* to 125*d* receives a supply of the fuel, which is fed from the fuel tank 60 by the fuel pump 62, is pressurized by a high-pressure fuel pump 64, and is delivered by a delivery pump 66. Electric power is supplied from a battery 50 via a DC-DC converter 90 to motors 62*a* and 64*a* working as actuators of the fuel pump 62 and the high-pressure fuel pump 64. A check valve (not shown) is located in an output side of the high-pressure fuel pump 64 to prevent a reverse flow of the fuel and keep the fuel pressure in the delivery pipe 66 at a certain level. The delivery pipe 66 has a relief pipe 68 that flows back the fuel into the fuel tank 60 via a relief valve 67, which works to prevent the fuel pressure from rising to an excess level. In the stop state of the engine 22, the pressure of the fuel supplied to the in-cylinder fuel injection valves 125*a* to 125*d* is lowered to a preset pressure level to prevent leakage of the fuel from the in-cylinder fuel injection valves 125*a* to 125*d*.

The engine 22 is under control of an engine electronic control unit (hereafter referred to as engine ECU) 24. The engine ECU 24 inputs signals from various sensors that measure and detect the current conditions of the engine 22 via an input port (not shown). The signals input into the engine ECU 24 via the input port include a crank position or rotational position of the crankshaft 26 from a crank position sensor 140, a cooling water temperature of the engine 22 from a water temperature sensor 142, a cam position or rotational position of a cam shaft, which opens and closes the intake valve 128 and an exhaust valve for intake and exhaust into and from the combustion chamber, a throttle position or position of the throttle valve 124 from a throttle valve position sensor 146, an amount of intake air as a load of the engine 22 from a vacuum sensor 148, and a fuel pressure Pf from a fuel pressure sensor 69, which is attached to the delivery pipe 66 to supply the fuel to the in-cylinder fuel injection valves 125*a* to 125*d*. The engine ECU 24 outputs diversity of drive signals and control signals to drive and control the engine 22 via an output port (not shown). The signals output from the engine ECU 24 via the output port include drive signals to the in-cylinder fuel injection valves 125*a* to 125*d* and the port fuel injection valves 126*a* to 126*d*, a drive signal to a throttle motor 136 that regulates the position of the throttle valve 124, a control signal to an ignition coil 138 that is arranged integrally with an igniter, a control signal to a variable valve timing mechanism 150 that varies an open-close timing VVT of the intake valve 128, and drive signals to the motors 62*a* and 64*a* of the fuel pump 62 and the high-pressure fuel pump 64. The engine ECU 24 establishes communication with the hybrid electronic control unit 70 to drive and control the engine 22 in response to control signals received from the hybrid electronic control unit 70, while outputting data regarding the driving conditions of the engine 22 to the hybrid electronic control unit 70 according to the requirements.

Both the motors MG1 and MG2 are known synchronous motor generators that are driven as a generator and as a motor. The motors MG1 and MG2 transmit electric power to and from a battery 50 connected with power lines 54 via inverters 41 and 42. Operations of both the motors MG1 and MG2 are controlled by a motor electronic control unit (hereafter referred to as motor ECU) 40. The motor ECU 40 receives diverse signals required for controlling the operations of the motors MG1 and MG2, for example, signals from rotational position detection sensors 43 and 44 that detect the rotational positions of rotors in the motors MG1 and MG2 and phase currents applied to the motors MG1 and MG2 and measured by current sensors (not shown). The motor ECU 40 outputs switching control signals to the inverters 41 and 42. The motor ECU 40 communicates with the hybrid electronic control unit 70 to control operations of the motors MG1 and MG2 in response to control signals transmitted from the hybrid electronic control unit 70 while outputting data relating to the operating conditions of the motors MG1 and MG2 to the hybrid electronic control unit 70 according to the requirements.

The battery 50 is under control of a battery electronic control unit (hereafter referred to as battery ECU) 52. The battery ECU 52 receives diverse signals required for control of the battery 50, for example, an inter-terminal voltage measured by a voltage sensor (not shown) disposed between terminals of the battery 50, a charge-discharge current measured by a current sensor (not shown) attached to the power line 54 connected with the output terminal of the battery 50, and a battery temperature measured by a temperature sensor (not shown) attached to the battery 50. The battery ECU 52 outputs data relating to the state of the battery 50 to the hybrid electronic control unit 70 via communication according to the requirements. The battery ECU 52 calculates a state of charge (SOC) of the battery 50, based on the accumulated charge-discharge current measured by the current sensor, for control of the battery 50.

The hybrid electronic control unit 70 is constructed as a microprocessor including a CPU 72, a ROM 74 that stores processing programs, a RAM 76 that temporarily stores data, and a non-illustrated input-output port, and a non-illustrated communication port. The hybrid electronic control unit 70 receives various inputs via the input port: an ignition signal from an ignition switch 80, a gearshift position SP from a gearshift position sensor 82 that detects the current position of a gearshift lever 81, an accelerator opening Acc from an accelerator pedal position sensor 84 that measures a step-on amount of an accelerator pedal 83, a brake pedal position BP from a brake pedal position sensor 86 that measures a step-on amount of a brake pedal 85, and a vehicle speed V from a vehicle speed sensor 88. The hybrid electronic control unit 70 communicates with the engine ECU 24, the motor ECU 40, and the battery ECU 52 via the communication port to transmit diverse control signals and data to and from the engine ECU 24, the motor ECU 40, and the battery ECU 52, as mentioned previously.

The hybrid vehicle 20 of the embodiment thus constructed calculates a torque demand to be output to the ring gear shaft 32*a* functioning as the drive shaft, based on observed values of a vehicle speed V and an accelerator opening Acc, which corresponds to a driver's step-on amount of an accelerator pedal 83. The engine 22 and the motors MG1 and MG2 are subjected to operation control to output a required level of power corresponding to the calculated torque demand to the ring gear shaft 32*a*. The operation control of the engine 22 and the motors MG1 and MG2 selectively effectuates one of a torque conversion drive mode, a charge-discharge drive mode, and a motor drive mode. The torque conversion drive mode controls the operations of the engine 22 to output a quantity of power equivalent to the required level of power, while driving and controlling the motors MG1 and MG2 to cause all the power output from the engine 22 to be subjected to torque conversion by means of the power distribution integration mechanism 30 and the motors MG1 and MG2 and output to the ring gear shaft 32*a*. The charge-discharge drive mode controls the operations of the engine 22 to output a quantity of power equivalent to the sum of the required level of power and a quantity of electric power consumed by charging the battery 50 or supplied by discharging the battery 50, while driving and controlling the motors MG1 and MG2 to cause all or part of the power output from the engine 22 equivalent to the required level of power to be subjected to torque conversion by means of the power distribution integration mechanism 30 and the motors MG1 and MG2 and output to the ring gear shaft 32*a*, simultaneously with charge or discharge of the battery 50. The motor drive mode stops the operations of the engine 22 and drives and controls the motor MG2 to output a quantity of power equivalent to the required level of power to the ring gear shaft 32*a*.

Figure 3:
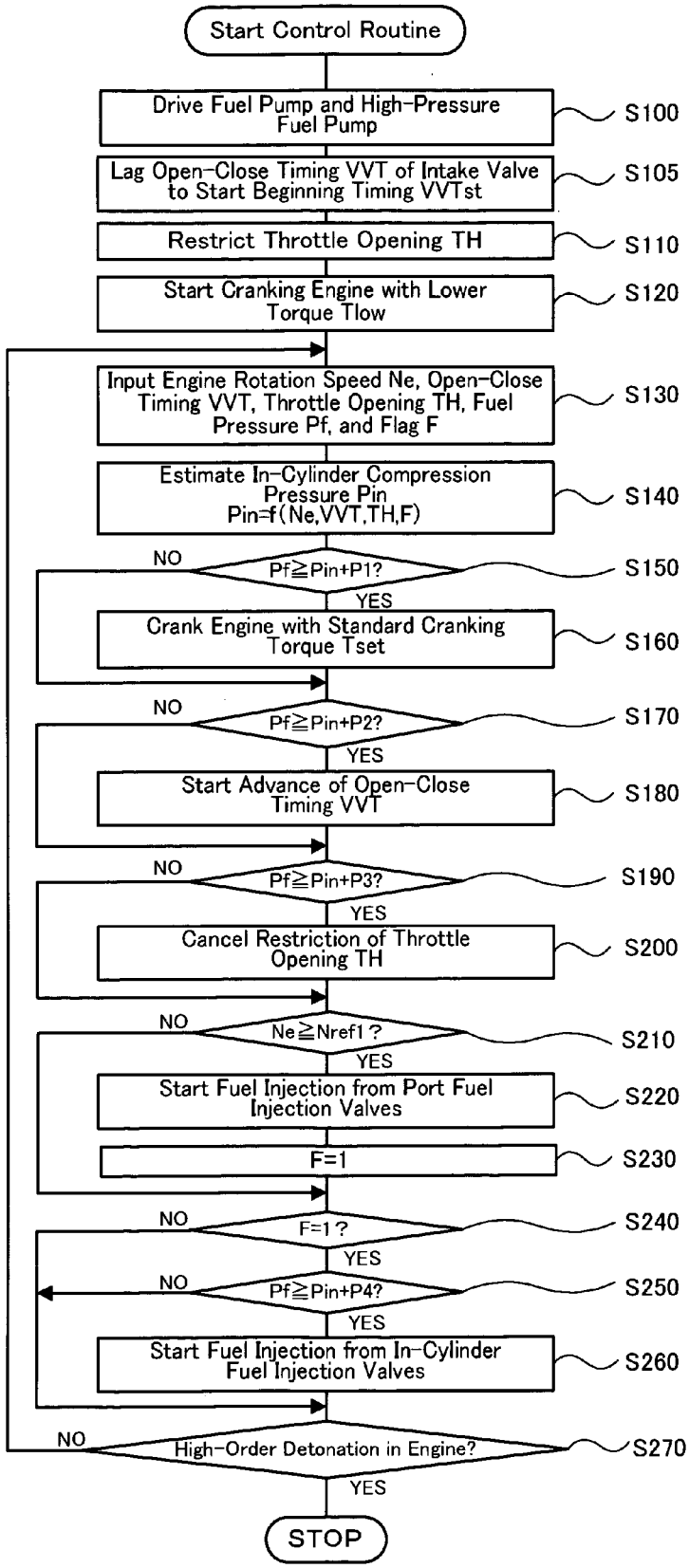
FIG. 3 is a flowchart showing a start control routine executed by an engine ECU in the hybrid vehicle of the embodiment.

The description now regards the operations of the hybrid vehicle 20 of the embodiment having the configuration discussed above, especially a series of start control operations at a first start of the engine 22 after activation of the system. FIG. 3 is a flowchart showing a start control routine executed by the engine ECU 24 of the embodiment in response to a first start instruction of the engine 22 after activation of the system. In the configuration of the embodiment, the start instruction of the engine 22 is given when a state of charge SOC of the battery 50 is less than a preset level at an activation timing of the system in response to an ON operation of a power switch, when the cooling water temperature of the engine 22 is lower than a predetermined temperature level, or when a power demand to be output to the ring gear shaft 32*a* or drive shaft reaches to or over a preset power level during a drive of the hybrid vehicle 20.

In the start control routine, the engine ECU 24 first drives the fuel pump 62 and the high-pressure fuel pump 64 to supply the fuel from the fuel tank 60 to the port fuel injection valves 126 and the in-cylinder fuel injection valves 125 and to raise a pressure Pf of the fuel (hereafter referred to as fuel pressure Pf) of the delivery pump 66 (step S100). The engine ECU 24 also drives the variable valve timing mechanism 150 to lag the open-close timing VVT of the intake valve 128 to a preset start beginning timing VVTst (step S105), and drives the throttle motor 136 to restrict an opening TH of the throttle valve 124 (hereafter referred to as throttle opening TH) to a narrower opening THst than a standard throttle opening in the state of idle driving (step S110). The engine ECU 24 then sends a motor drive request to the hybrid electronic control unit 70 to make the motor MG1 start cranking the engine 22 with a lower torque Tlow than a standard cranking torque Tset (step S120). The lag of the open-close timing VVT of the intake valve 128 to the start beginning timing VVTst and the restriction of the throttle opening TH reduce a rise in in-cylinder pressure Pin in the compression process by cranking of the engine 22 (hereafter referred to as in-cylinder compression pressure Pin) and decrease energy consumed for cranking. Cranking of the engine 22 with the lower torque Tlow than the standard cranking torque Tset prevents an abrupt rise in in-cylinder compression pressure Pin with an increase in rotation speed Ne of the engine 22. The effects of such controls will be discussed later in detail. In response to reception of this motor drive request to make the motor MG1 crank the engine 22 with the lower torque Tlow, the hybrid electronic control unit 70 sets the lower torque Tlow to a torque command Tm1* of the motor MG1 and outputs a driving instruction to the motor ECU 40. The motor ECU 40 receives the torque command Tm1* equal to the lower torque Tlow and controls switching elements of the inverter 41 to ensure output of a torque equivalent to the torque command Tm1* from the motor MG1.

The engine ECU 24 subsequently inputs the rotation speed Ne of the engine 22 computed from the crank position detected by the crank position sensor 140, the open-close timing VVT varied by the variable valve timing mechanism 150, the throttle opening TH from the throttle valve position sensor 146, the fuel pressure Pf from the fuel pressure sensor 69, and a port injection start flag F representing a start of fuel injection from the port fuel injection valves 126 (step S130). The in-cylinder compression pressure Pin is estimated based on the input rotation speed Ne of the engine 22, the input open-close timing VVT, and the port injection start flag F (step S140). A concrete procedure of estimating the in-cylinder compression pressure Pin calculates the amount of air intake from the rotation speed Ne of the engine 22 and the open-close timing VVT. In the case of the port injection start flag F equal to 0 representing no fuel injection from the port fuel injection valves 126, the in-cylinder compression pressure Pin is estimated as a product of the calculated amount of air intake and a preset compression ratio. In the case of the port injection start flag F equal to 1 representing fuel injection from the port fuel injection valves 126, on the other hand, the in-cylinder compression pressure Pin is estimated as a sum of this product and an experimentally measured fuel pressure. Estimation of the in-cylinder compression pressure Pin is not restricted to this procedure, but another technique may be adopted to estimate the in-cylinder compression pressure Pin. Another possible modification may attach an in-cylinder pressure sensor to the engine 22 and directly measure the in-cylinder compression pressure Pin. The port injection start flag F is set by subsequent processing of steps S210 to S230 in this start control routine, and is initialized to 0 at the beginning of this routine.

The fuel pressure Pf is compared with a first reference value (Pin+P1) obtained as a sum of the estimated in-cylinder compression pressure Pin and a preset pressure P1, which is slightly higher than a pressure Pcv for keeping the in-cylinder fuel injection valves 125 in a closed position (hereafter referred to as closed valve position-retaining pressure Pcv) (step S150). When the fuel pressure Pf increases to or over the first reference value (Pin+P1), the engine ECU 24 sends a motor drive request to the hybrid electronic control unit 70 to make the motor MG1 crank the engine 22 with the standard cranking torque Tset higher than the lower torque Tlow (step S160). In response to reception of this motor drive request, the hybrid electronic control unit 70 sets the standard cranking torque Tset to the torque command Tm1* of the motor MG1 and outputs a driving instruction to the motor ECU 40. The motor ECU 40 receives the torque command Tm1* equal to the standard cranking torque Tset and drives and controls the motor MG1 to output the standard cranking torque Tset and crank the engine 22 with the standard cranking torque Tset. The engine 22 cranked with the standard cranking torque Tset raises the rotation speed Ne at a greater increase rate, compared with the engine 22 cranked with the lower torque Tlow. The engine 22 is cranked with the lower torque Tlow than the standard cranking torque Tset, before the fuel pressure Pf reaches or exceeds the first reference value (Pin+P1). Such control restricts an increase in rotation speed Ne of the engine 22 to prevent an abrupt rise in in-cylinder compression pressure Pin, while delaying a start of fuel injection from the port fuel injection valves 126. The delayed start of fuel injection from the port fuel injection valves 126 slows down the rise in in-cylinder compression pressure Pin and enables the fuel pressure Pf to quickly rise to or over a sum of the in-cylinder compression pressure Pin and the closed valve position-retaining pressure Pcv.

The fuel pressure Pf is subsequently compared with a second reference value (Pin+P2) obtained as a sum of the estimated in-cylinder compression pressure Pin and a preset pressure P2, which is slightly higher than the closed valve position-retaining pressure Pcv (step S170). When the fuel pressure Pf increases to or over the second reference value (Pin+P2), the engine ECU 24 outputs a drive request to the variable valve timing mechanism 150 to start an advance of the lagged open-close timing VVT (step S180). The open-close timing VVT is gradually advanced according to the driving conditions of the engine 22. The advance of the open-close timing VVT increases the amount of air intake and thereby raises the in-cylinder compression pressure Pin. The advance of the open-close timing VVT starts when the fuel pressure Pf reaches or exceeds the second reference value (Pin+P2). Such control enables the fuel pressure Pf to quickly rise to or over the sum of the in-cylinder compression pressure Pin and the closed valve position-retaining pressure Pcv.

The fuel pressure Pf is then compared with a third reference value (Pin+P3) obtained as a sum of the estimated in-cylinder compression pressure Pin and a preset pressure P3, which is slightly higher than the closed valve position-retaining pressure Pcv (step S190). When the fuel pressure Pf increases to or over the third reference value (Pin+P3), the engine ECU 24 cancels the restriction of the throttle opening TH and drives the throttle motor 136 to set the throttle opening TH equal to an idling throttle opening THidl in the state of idling drive (step S200). The cancellation of the restricted throttle opening TH increases the amount of air intake and thereby raises the in-cylinder compression pressure Pin. The restriction of the throttle opening TH is cancelled when the fuel pressure Pf reaches or exceeds the third reference value (Pin+P3). Such control enables the fuel pressure Pf to quickly rise to or over the sum of the in-cylinder compression pressure Pin and the closed valve position-retaining pressure Pcv.

The rotation speed Ne of the engine 22 is compared with a preset reference speed Nref1 (step S210). When the rotation speed Ne of the engine 22 reaches or exceeds the preset reference speed Nref1, the engine ECU 24 starts fuel injection from the port fuel injection valves 126 (step S220) and sets the port fuel injection start flag F equal to 1 (step S230). The reference speed Nref1 represents a start timing of fuel injection from the port fuel injection valves 126 and may be set to any arbitrary value.

When it is determined that the port fuel injection start flag F is equal to 1 (step S240) and that the fuel pressure Pf reaches or exceeds a fourth reference value (Pin+P4) obtained as a sum of the estimated in-cylinder compression pressure Pin and a preset pressure P4, which is slightly higher than the closed valve position-retaining pressure Pcv (step S250), the engine ECU 24 starts fuel injection from the in-cylinder fuel injection valves 125 (step S260). The fuel injection from the in-cylinder fuel injection valves 125 starts when the fuel pressure Pf reaches or exceeds the fourth reference value (Pin+P4). Such control effectively restrains the in-cylinder fuel injection valves 125 from being inadequately opened due to the lower fuel pressure Pf than the sum of the in-cylinder compression pressure Pin and the closed valve position-retaining pressure Pcv. This desirably prevents potential troubles caused by the inadequate opening of the in-cylinder fuel injection valves 125, for example, the poorer emission, the worsened sealing property in the combustion chamber in the vicinity of the in-cylinder fuel injection valves 125, and the clog of the in-cylinder fuel injection valves 125 with deposit.

As described above, cranking of the engine 22 with the lower torque Tlow than the standard cranking torque Tset prevents an abrupt rise in in-cylinder compression pressure Pin with an increase in rotation speed Ne of the engine 22. The delayed start of fuel injection from the port fuel injection valves 126 slows down the rise in in-cylinder compression pressure Pin. The start of the advance of the open-close timing VVT at the fuel pressure Pf rising to or over the second reference value (Pin+P2) also slows down the rise in in-cylinder compression pressure Pin. The cancellation of the restricted throttle opening TH at the fuel pressure Pf rising to or above the third reference value (pin+P3) also slows down the rise in in-cylinder compression pressure Pin. Such control enables the fuel pressure Pf to quickly rise to or above the fourth reference value (Pin+P4) and effectively restrains the in-cylinder fuel injection valves 125 from being inadequately opened due to the lower fuel pressure Pf than the sum of the in-cylinder compression pressure Pin and the closed valve position-retaining pressure Pcv. The preset pressures P1, P2, P3, and P4 in the first to the fourth reference values (Pin+P1), (Pin+P2), (Pin+P3), and (Pin+P4) are all slightly higher than the closed valve position-retaining pressure Pcv. These preset pressures P1, P2, P3, and P4 may be an identical value or different values. In the latter case, the pressures P1 to P3 are preferably set to be less than the pressure P4, in order to crank the engine 22 with the standard cranking torque Tset, to start the advance of the open-close timing VVT, and to cancel the restriction of the throttle opening TH.

After the above series of processing, the start control routine is terminated on confirmation of high-order detonation in the engine 22 with fuel injection from the in-cylinder fuel injection valves 125 (step S270). Until the fuel pressure Pf reaches or exceeds the fourth reference value (Pin+P4), there has been no confirmation of high-order detonation in the engine 22 with fuel injection from the in-cylinder fuel injection valves 125. The start control routine accordingly goes back to step S130 and repeats the processing of steps S130 to S270.

Figure 4:
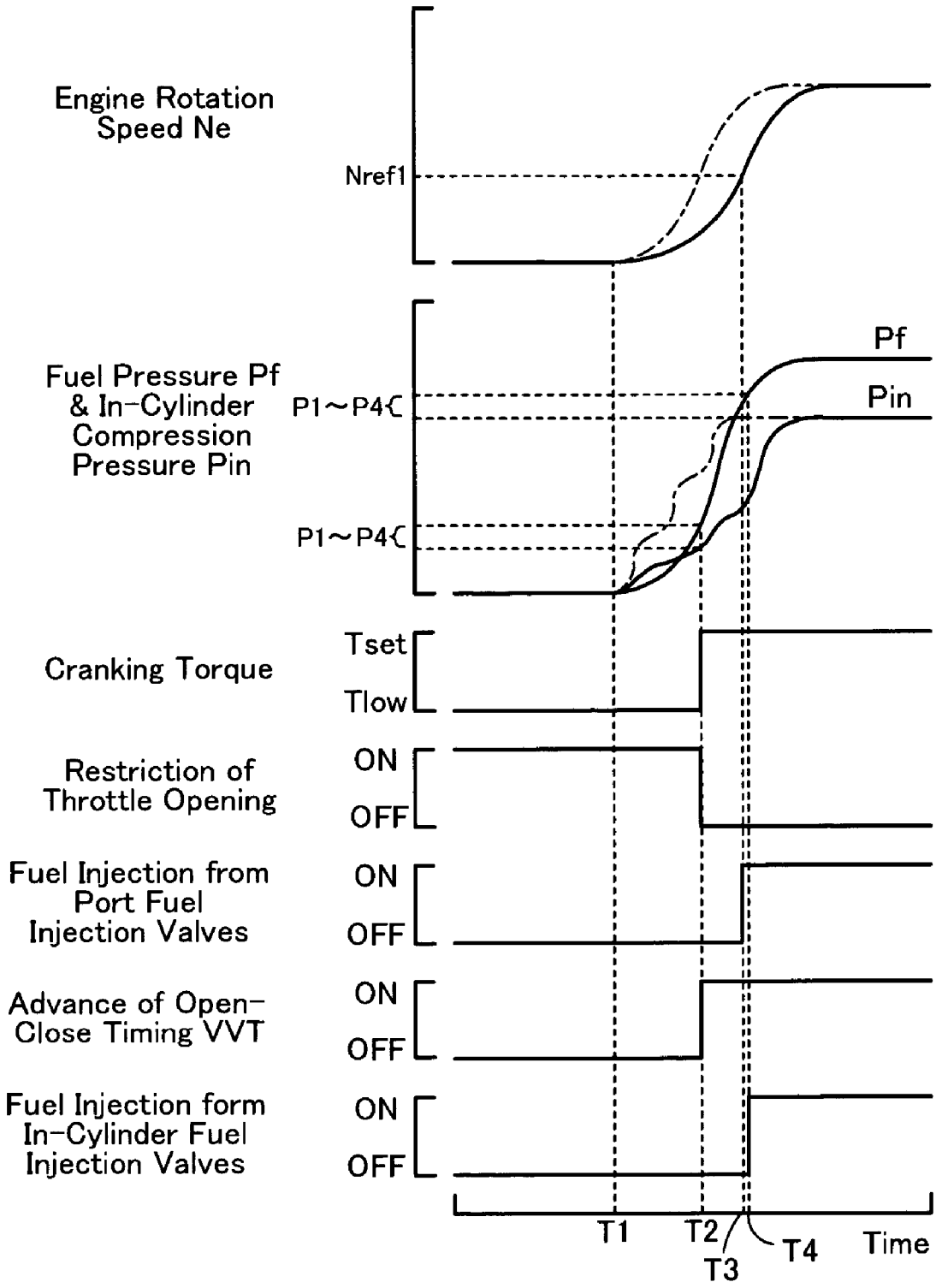
FIG. 4 is a graph showing time variations of an in-cylinder compression pressure Pin, a fuel pressure Pf, a throttle opening TH, and an open-close timing VVT of an intake valve at a first start of the engine after activation of the internal combustion engine system.

FIG. 4 is a graph showing time variations of the in-cylinder compression pressure Pin, the fuel pressure Pf, the rotation speed Ne of the engine 22, and the cranking torque as well as on-off settings of restriction of the throttle opening TH, fuel injection from the port fuel injection valves 126, advance of the open-close timing VVT, and fuel injection from the in-cylinder fuel injection valves 125 at a first start of the engine 22 after activation of the system. In the graph of FIG. 4, the solid line curves represent the variations under execution of the start control routine of the embodiment shown in the flowchart of FIG. 3 to start the engine 22. The one-dot chain line curves represent the variations under execution of prior art control of a comparative example to start the engine 22 by cranking the engine 22 with the standard cranking torque Tset and by starting the advance of the open-close timing VVT and canceling the restriction of the throttle opening TH independently of a variation in fuel pressure Pf. The control procedure of the embodiment starts cranking of the engine 22 with the lower torque Tlow than the standard cranking torque Tset in response to a start instruction at a time T1. This slows down the increase rate of the rotation speed Ne of the engine 22, compared with the prior art procedure of the comparative example. At a time T2 when the fuel pressure Pf reaches or exceeds the sum of the in-cylinder compression pressure Pin and the closed valve position-retaining pressure Pcv, the control procedure cranks the engine 22 with the standard cranking torque Tset, starts the advance of the open-close timing VVT, and cancels the restriction of the throttle opening TH. Such engine cranking, advanced timing, and canceled restriction cause an abrupt increase in in-cylinder compression pressure Pin, while raising the fuel pressure Pf to or above the sum of the in-cylinder compression pressure Pin and the closed valve position-retaining pressure Pcv. This control thus effectively prevents the in-cylinder fuel injection valves 125 from being inadequately opened. At a time T3 when the rotation speed Ne of the engine 22 reaches or exceeds the preset reference speed Nref1, the control procedure starts fuel injection from the port fuel injection valves 126. At a time T4, the control procedure starts fuel injection from the in-cylinder fuel injection valves 125 to complete the start of the engine 22. In the comparative example, on the other hand, the in-cylinder compression pressure Pin has a greater increase rate than that of the fuel pressure Pf. Until the time T4, the fuel pressure Pf does not reach or exceed the sum of the in-cylinder compression pressure Pin and the closed valve position-retaining pressure Pcv.

In the hybrid vehicle 20 of the embodiment described above, at a first start of the engine 22 after activation of the system, fuel injection from the in-cylinder fuel injection valves 125 starts when the fuel pressure Pf in the delivery pipe 66 for supply of the fuel to the in-cylinder fuel injection valves 125 reaches or exceeds the fourth reference value (Pin+P4) as the sum of the estimated in-cylinder compression pressure Pin and the preset pressure P4 slightly higher than the closed valve position-retaining pressure Pcv. Such control effectively prevents potential troubles caused by the inadequate opening of the in-cylinder fuel injection valves 125 due to the lower fuel pressure Pf than the sum of the in-cylinder compression pressure Pin and the closed valve position-retaining pressure Pcv. This ensures an adequate start of the engine 22. The control procedure of the embodiment starts cranking the engine 22 with the lower torque Tlow than the standard cranking torque Tset, starts the advance of the open-close timing VVT at the fuel pressure Pf rising to or above the second reference value (Pin+P2) that is higher than the in-cylinder compression pressure Pin, and cancels the restriction of the throttle opening TH at the fuel pressure Pf rising to or above the third reference value (Pin+P3) that is higher than the in-cylinder compression pressure Pin. Such control slows down the increase in in-cylinder compression pressure Pin and enables the fuel pressure Pf to quickly rise to or above the fourth reference value (Pin+P4). This desirably restrains the in-cylinder fuel injection valves 125 from being inadequately opened and prevents potential troubles caused by the inadequate opening of the in-cylinder fuel injection valves 125, thus ensuring an adequate and quick start of the engine 22.

Figure 5:
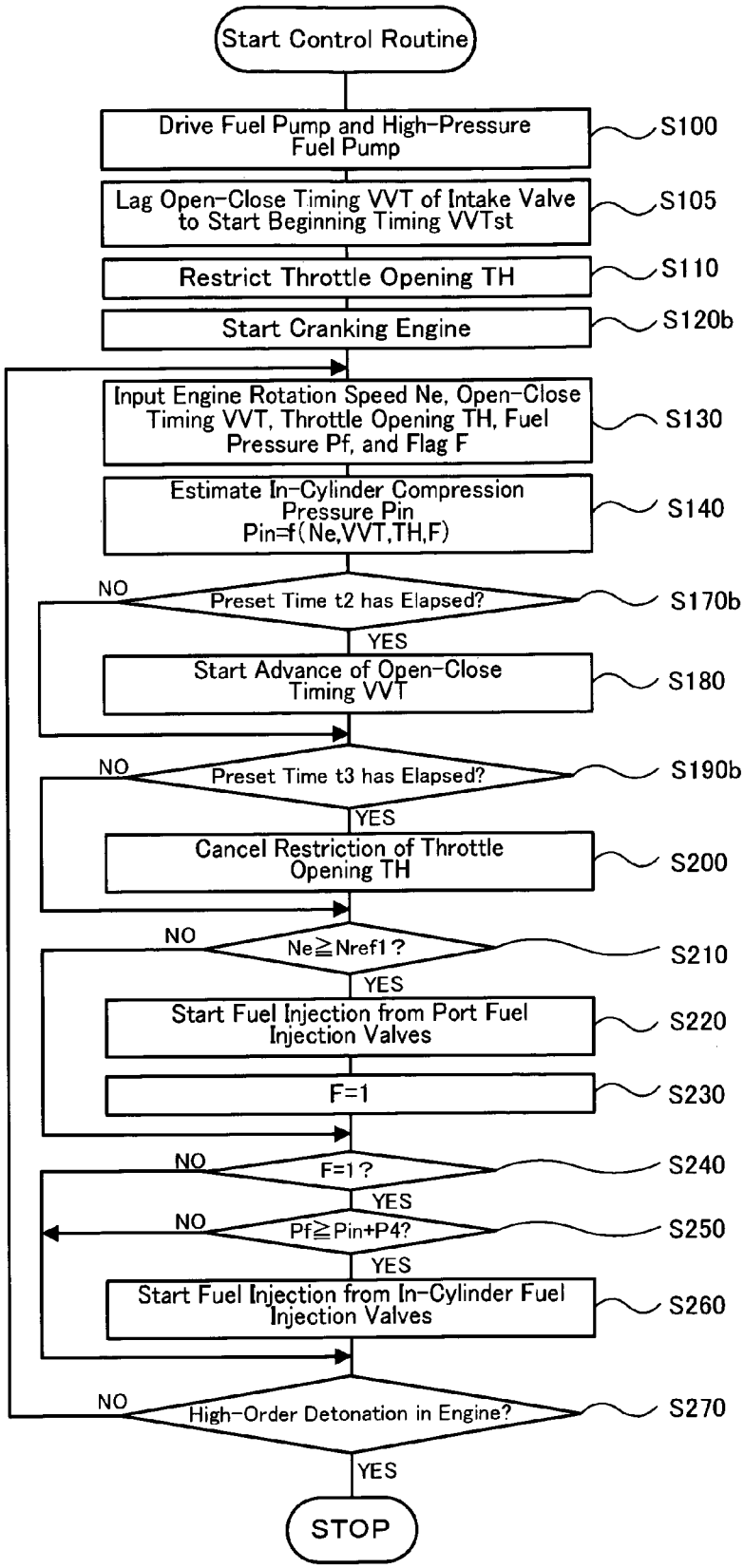
FIG. 5 is a flowchart showing a modified start control routine as one possible modification.

In the hybrid vehicle 20 of the embodiment, the control procedure starts cranking the engine 22 with the lower torque Tlow than the standard cranking torque Tset, starts the advance of the open-close timing VVT at the fuel pressure Pf rising to or above the second reference value (Pin+P2) that is higher than the in-cylinder compression pressure Pin, and cancels the restriction of the throttle opening TH at the fuel pressure Pf rising to or above the third reference value (Pin+P3) that is higher than the in-cylinder compression pressure Pin. The prerequisite is to start the fuel injection from the in-cylinder fuel injection valves 125 when the fuel pressure Pf reaches or exceeds the fourth reference value (Pin+P4) as the sum of the in-cylinder compression pressure Pin and the preset pressure P4 slightly higher than the closed valve position-retaining pressure Pcv. As long as this prerequisite is satisfied, the control procedure may be modified to start cranking the engine 22 with the standard cranking torque Tset, to start the advance of the open-close timing VVT independently of the fuel pressure Pf, and to cancel the restriction of the throttle opening TH independently of the fuel pressure Pf. One example of such modification is shown in the flowchart of FIG. 5. The modified start control routine of FIG. 5 starts cranking the engine 22 with the standard cranking torque Tset (step S120*b*), starts the advance of the open-close timing VVT after elapse of a preset time t2 from the beginning of the start control routine (steps S170*b* and S180), and cancels the restriction of the throttle opening TH after elapse of a preset time t3 from the beginning of the start control routine (steps S190*b* and S200). The modified start control routine starts fuel injection from the port fuel injection valves 126 when the rotation speed Ne of the engine 22 reaches or exceeds the preset reference speed Nref1 (steps S210 and S220). The modified start control routine starts fuel injection from the in-cylinder fuel injection valves 125 when the fuel pressure Pr reaches or exceeds the fourth reference value (Pin+P4) in the condition of the fuel injection from the port fuel injection valves 126 (steps S240 to S260). The modified control procedure starts fuel injection from the in-cylinder fuel injection valves 125 when the fuel pressure Pf reaches or exceeds the fourth reference value (Pin+P4) as the sum of the in-cylinder compression pressure Pin and the preset pressure P4 slightly higher than the closed valve position-retaining pressure Pcv. Such control effectively restrains the in-cylinder fuel injection valves 125 from being inadequately opened. The modified start control routine of FIG. 5 starts the advance of the open-close timing VVT after elapse of the preset time t2 from the beginning of the start control routine and cancels the restriction of the throttle opening TH after elapse of the preset time t3 from the beginning of the start control routine. As mentioned above, the prerequisite in this modified control is to start the fuel injection from the in-cylinder fuel injection valves 125 when the fuel pressure Pf reaches or exceeds the fourth reference value (Pin+P4) as the sum of the in-cylinder compression pressure Pin and the preset pressure P4 slightly higher than the closed valve position-retaining pressure Pcv. As long as this prerequisite is satisfied, the start of the advance of the open-close timing VVT and the cancellation of the restriction of the throttle opening TH are not restricted to the timings of this modified procedure. The advance start timing and the restriction cancellation timing may be determined on the basis of a criterion other than the elapse of time from the beginning of the start control routine and are set to, for example, timings when the rotation speed Ne of the engine 22 reaches a preset first level and a preset second level.

Figure 6:
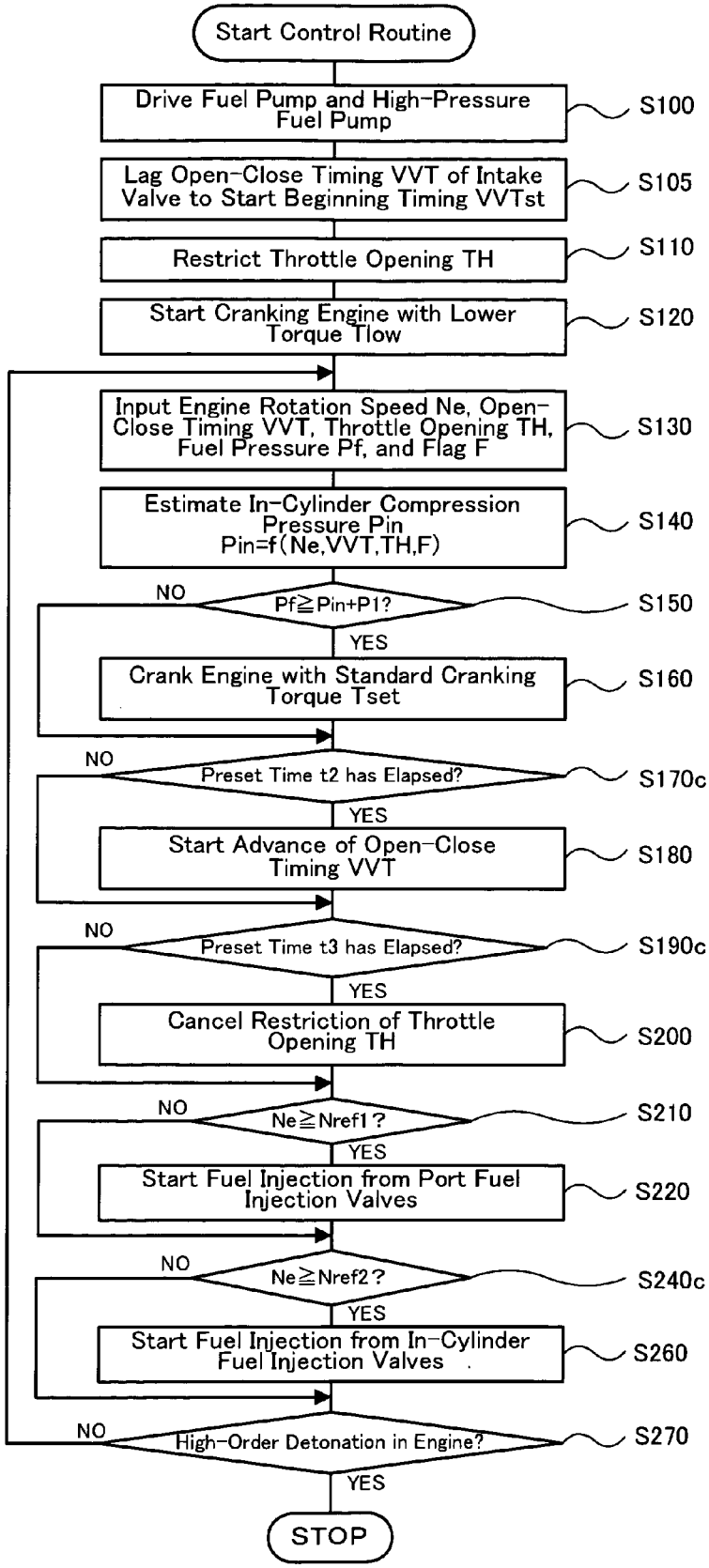
FIG. 6 is a flowchart showing another modified start control routine as another possible modification.

In the hybrid vehicle 20 of the embodiment, the control procedure starts the advance of the open-close timing VVT at the fuel pressure Pf rising to or above the second reference value (Pin+P2) that is higher than the in-cylinder compression pressure Pin, cancels the restriction of the throttle opening TH at the fuel pressure Pf rising to or above the third reference value (Pin+P3) that is higher than the in-cylinder compression pressure Pin, and starts fuel injection from the in-cylinder fuel injection valves 125 at the fuel pressure Pf rising to or above the fourth reference value (Pin+P4) that is higher than the in-cylinder compression pressure Pin. The prerequisite is to start cranking the engine 22 with the lower toque Tlow than the standard cranking torque Tset and to crank the engine 22 with the standard cranking torque Tset when the fuel pressure Pf reaches or exceeds the first reference value (Pin+P1) as the sum of the in-cylinder compression pressure Pin and the preset pressure P1 slightly higher than the closed valve position-retaining pressure Pcv. As long as this prerequisite is satisfied, the control procedure may be modified to start the advance of the open-close timing VVT independently of the fuel pressure Pf, to cancel the restriction of the throttle opening TH independently of the fuel pressure Pf, and to start fuel injection from the in-cylinder fuel injection valves 125 independently of the fuel pressure Pf. One example of such modification is shown in the flowchart of FIG. 6. Like the start control routine of the embodiment, the modified start control routine of FIG. 6 starts cranking the engine 22 with the lower torque Tlow than the standard cranking torque Tset (step S120) and cranks the engine 22 with the standard cranking torque Tset when the fuel pressure Pf reaches or exceeds the first reference value (Pin+P1) as the sum of the in-cylinder compression pressure Pin and the preset pressure P1 slightly higher than the closed valve position-retaining pressure Pcv (steps S150 and S160). The modified start control routine starts the advance of the open-close timing VVT after elapse of a preset time t2 from the beginning of the start control routine (steps S170*c* and S180), and cancels the restriction of the throttle opening TH after elapse of a preset time t3 from the beginning of the start control routine (steps S190*c* and S200). The modified start control routine starts fuel injection from the port fuel injection valves 126 when the rotation speed Ne of the engine 22 reaches or exceeds a preset first reference speed Nref1 (steps S210 and S220). The modified start control routine starts fuel injection from the in-cylinder fuel injection valves 125 when the rotation speed Ne of the engine 22 reaches or exceeds a preset second reference speed Nref2, which is higher than the preset first reference speed Nref1 (steps S240*c* and S260). The modified control procedure starts cranking the engine 22 with the lower torque Tlow than the standard cranking torque Tset. Such engine cranking with the lower torque Tlow slows down the increase rate of the rotation speed Ne of the engine 22 and accordingly prevents an abrupt rise in in-cylinder compression pressure Pin with the increase in rotation speed Ne. The engine cranking with the lower torque Tlow also delays the start of fuel injection from the port fuel injection valves 126 to slow down the increase of the in-pressure compression pressure Pin, and enables the fuel pressure Pf to quickly rise to or above the sum of the in-cylinder compression pressure Pin and the closed valve position-retaining pressure Pcv. Such control effectively restrains the in-cylinder fuel injection valves 125 from being inadequately opened. The modified start control routine of FIG. 6 starts the advance of the open-close timing VVT after elapse of the preset time t2 from the beginning of the start control routine and cancels the restriction of the throttle opening TH after elapse of the preset time t3 from the beginning of the start control routine. As mentioned above, the prerequisite in this modified control is to start cranking the engine 22 with the lower toque Tlow than the standard cranking torque Tset and to crank the engine 22 with the standard cranking torque Tset when the fuel pressure Pf reaches or exceeds the first reference value (Pin+P1) as the sum of the in-cylinder compression pressure Pin and the preset pressure P1 slightly higher than the closed valve position-retaining pressure Pcv. As long as this prerequisite is satisfied, the start of the advance of the open-close timing VVT and the cancellation of the restriction of the throttle opening TH are not restricted to the timings of this modified procedure. The advance start timing and the restriction cancellation timing may be determined on the basis of a criterion other than the elapse of time from the beginning of the start control routine and are set to, for example, timings when the rotation speed Ne of the engine 22 reaches a preset first level and a preset second level. The modified start control routine of FIG. 6 starts fuel injection from the in-cylinder fuel injection valves 125 when the rotation speed Ne of the engine 22 reaches or exceeds the preset second reference speed Nref2. Another possible modification may start fuel injection from the in-cylinder fuel injection valves 125 when the fuel pressure Pr reaches or exceeds the fourth reference value (Pin+P4) as the sum of the in-cylinder compression pressure Pin and the preset pressure P4 slightly higher than the closed valve position-retaining pressure Pcv, in the condition of the fuel injection from the port fuel injection valves 126.

Figure 7:
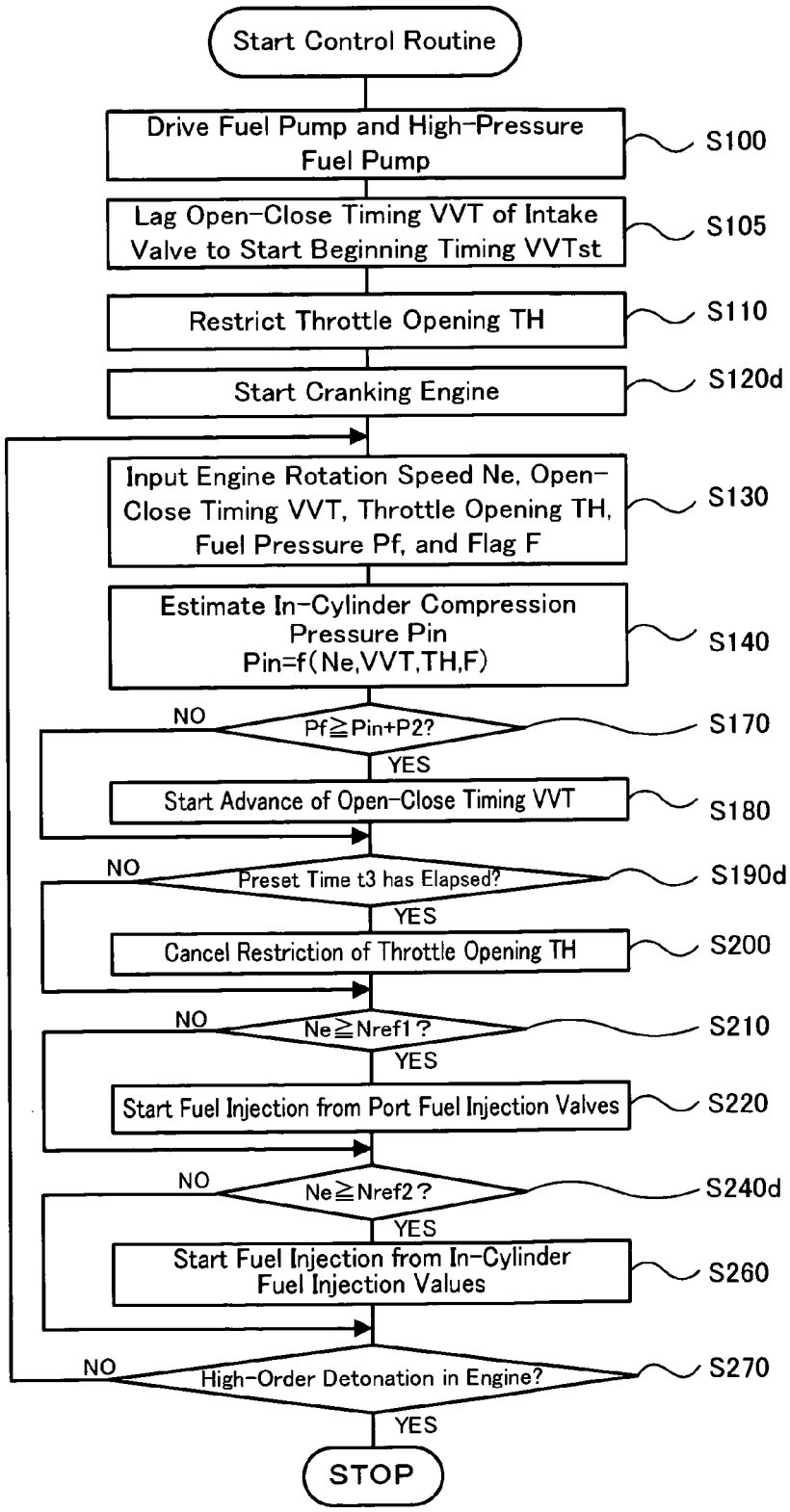
FIG. 7 is a flowchart showing still another modified start control routine as still another possible modification.

In the hybrid vehicle 20 of the embodiment, the control procedure starts cranking the engine 22 with the lower torque Tlow than the standard cranking torque Tset, cancels the restriction of the throttle opening TH at the fuel pressure Pf rising to or above the third reference value (Pin+P3) that is higher than the in-cylinder compression pressure Pin, and starts fuel injection from the in-cylinder fuel injection valves 125 at the fuel pressure Pf rising to or above the fourth reference value (Pin+P4) that is higher than the in-cylinder compression pressure Pin. The prerequisite is to start the advance of the open-close timing VVT at the fuel pressure Pf rising to or above the second reference value (Pin+P2) that is higher than the in-cylinder compression pressure Pin. As long as this prerequisite is satisfied, the control procedure may be modified to start cranking the engine 22 with the standard cranking torque Tset, to cancel the restriction of the throttle opening TH independently of the fuel pressure Pf, and to start fuel injection from the in-cylinder fuel injection valves 125 independently of the fuel pressure Pf. One example of such modification is shown in the flowchart of FIG. 7. The modified start control routine of FIG. 7 starts cranking the engine 22 with the standard cranking torque Tset (step S120*d*), and starts the advance of the open-close timing VVT when the fuel pressure Pf reaches or exceeds the second reference value (Pin+P2) as the sum of the in-cylinder compression pressure Pin and the preset pressure P2 slightly higher than the closed valve position-retaining pressure Pcv (steps S170 and S180). The modified start control routine cancels the restriction of the throttle opening TH after elapse of a preset time t3 from the beginning of the start control routine (steps S190*d* and S200), and starts fuel injection from the port fuel injection valves 126 when the rotation speed Ne of the engine 22 reaches or exceeds a preset first reference speed Nref1 (steps S210 and S220). The modified start control routine starts fuel injection from the in-cylinder fuel injection valves 125 when the rotation speed Ne of the engine 22 reaches or exceeds a preset second reference speed Nref2, which is higher than the preset first reference speed Nref1 (steps S240*d* and S260). The modified control procedure slows down the increase in amount of air intake induced by the advance of the open-close timing VVT to control the increase of the in-pressure compression pressure Pin, and enables the fuel pressure Pf to quickly rise to or above the sum of the in-cylinder compression pressure Pin and the closed valve position-retaining pressure Pcv. Such control effectively restrains the in-cylinder fuel injection valves 125 from being inadequately opened. The modified start control routine of FIG. 7 starts cranking the engine 22 with the standard cranking torque Tset. The cranking of the engine 22 may, however, start with the lower torque Tlow than the standard cranking torque Tset and subsequently with the standard cranking torque Tset. The modified start control routine of FIG. 7 cancels the restriction of the throttle opening TH after elapse of the preset time t3 from the beginning of the start control routine. As mentioned above, the prerequisite in this modified control is to start the advance of the open-close timing VVT at the fuel pressure Pf rising to or above the second reference value (Pin+P2) that is higher than the in-cylinder compression pressure Pin.

As long as this prerequisite is satisfied, the cancellation of the restriction of the throttle opening TH is not restricted to the timing of this modified procedure. The restriction cancellation timing may be determined on the basis of a criterion other than the elapse of time from the beginning of the start control routine and is set to, for example, a timing when the rotation speed Ne of the engine 22 reaches a preset level. The modified start control routine of FIG. 7 starts fuel injection from the in-cylinder fuel injection valves 125 when the rotation speed Ne of the engine 22 reaches or exceeds the preset second reference speed Nref2. Another possible modification may start fuel injection from the in-cylinder fuel injection valves 125 when the fuel pressure Pf reaches or exceeds the fourth reference value (Pin+P4) as the sum of the in-cylinder compression pressure Pin and the preset pressure P4 slightly higher than the closed valve position-retaining pressure Pcv, in the condition of the fuel injection from the port fuel injection valves 126.

Figure 8:
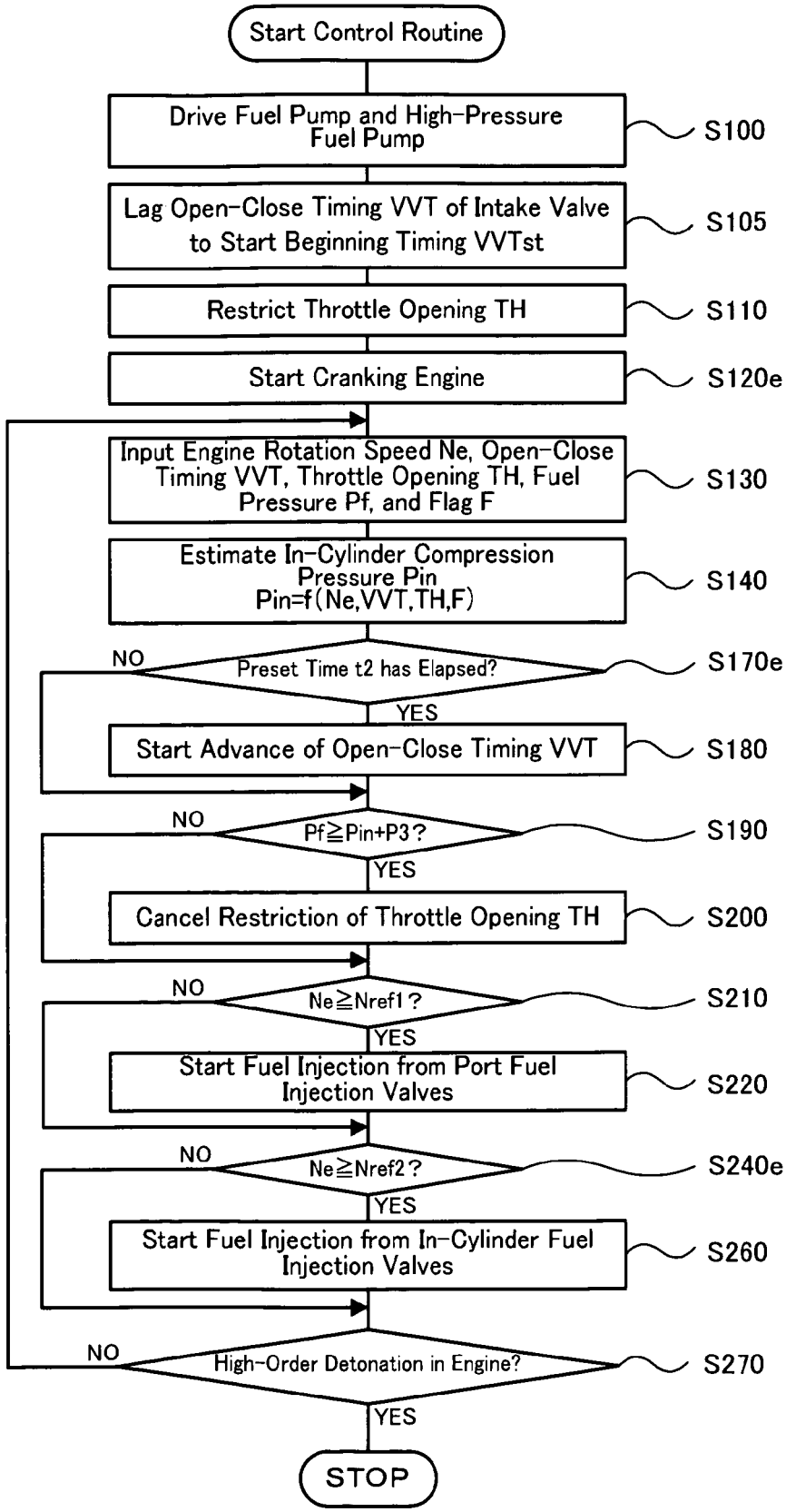
FIG. 8 is a flowchart showing another modified start control routine as another possible modification.

In the hybrid vehicle 20 of the embodiment, the control procedure starts cranking the engine 22 with the lower torque Tlow than the standard cranking torque Tset, starts the advance of the open-close timing VVT at the fuel pressure Pf rising to or above the second reference value (Pin+P2) that is higher than the in-cylinder compression pressure Pin, and starts fuel injection from the in-cylinder fuel injection valves 125 at the fuel pressure Pf rising to or above the fourth reference value (Pin+P4) that is higher than the in-cylinder compression pressure Pin. The prerequisite is to cancel the restriction of the throttle opening TH at the fuel pressure Pf rising to or above the third reference value (Pin+P3) that is higher than the in-cylinder compression pressure Pin. As long as this prerequisite is satisfied, the control procedure may be modified to start cranking the engine 22 with the standard cranking torque Tset, to start the advance of the open-close timing VVT independently of the fuel pressure Pf, and to start fuel injection from the in-cylinder fuel injection valves 125 independently of the fuel pressure Pf. One example of such modification is shown in the flowchart of FIG. 8. The modified start control routine of FIG. 8 starts cranking the engine 22 with the standard cranking torque Tset (step S120*e*), and starts the advance of the open-close timing VVT after elapse of a preset time t2 from the beginning of the start control routine (steps S170*e* and S180). The modified start control routine cancels the restriction of the throttle opening TH when the fuel pressure Pf reaches or exceeds the third reference value (Pin+P3) as the sum of the in-cylinder compression pressure Pin and the preset pressure P3 slightly higher than the closed valve position-retaining pressure Pcv (steps S190 and S200). The modified start control routine starts fuel injection from the port fuel injection valves 126 when the rotation speed Ne of the engine 22 reaches or exceeds a preset first reference speed Nref1 (steps S210 and S220). The modified start control routine starts fuel injection from the in-cylinder fuel injection valves 125 when the rotation speed Ne of the engine 22 reaches or exceeds a preset second reference speed Nref2, which is higher than the preset first reference speed Nref1 (steps S240*e* and S260). The restriction of the throttle opening TH slows down the increase in amount of air intake to control the increase of the in-pressure compression pressure Pin, and enables the fuel pressure Pf to quickly rise to or above the sum of the in-cylinder compression pressure Pin and the closed valve position-retaining pressure Pcv. Such control effectively restrains the in-cylinder fuel injection valves 125 from being inadequately opened. The modified start control routine of FIG. 8 starts cranking the engine 22 with the standard cranking torque Tset. The cranking of the engine 22 may, however, start with the lower torque Tlow than the standard cranking torque Tset and subsequently with the standard cranking torque Tset. The modified start control routine of FIG. 8 starts the advance of the open-close timing VVT after elapse of the preset time t2 from the beginning of the start control routine. As mentioned above, the prerequisite in this modified control is to cancel the restriction of the throttle opening TH at the fuel pressure Pf rising to or above the third reference value (Pin+P3) that is higher than the in-cylinder compression pressure Pin. As long as this prerequisite is satisfied, the start of the advance of the open-close timing VVT is not restricted to the timing of this modified procedure. The advance start timing may be determined on the basis of a criterion other than the elapse of time from the beginning of the start control routine and is set to, for example, a timing when the rotation speed Ne of the engine 22 reaches a preset level. The modified start control routine of FIG. 8 starts fuel injection from the in-cylinder fuel injection valves 125 when the rotation speed Ne of the engine 22 reaches or exceeds the preset second reference speed Nref2. Another possible modification may start fuel injection from the in-cylinder fuel injection valves 125 when the fuel pressure Pr reaches or exceeds the fourth reference value (Pin+P4) as the sum of the in-cylinder compression pressure Pin and the preset pressure P4 slightly higher than the closed valve position-retaining pressure Pcv, in the condition of the fuel injection from the port fuel injection valves 126.

The hybrid vehicle 20 of the embodiment or any of the various modified examples has the engine 22 equipped with both the in-cylinder fuel injection valves 125 and the port fuel injection valves 126. The hybrid vehicle may alternatively have an engine without the port fuel injection valves 126, that is, an engine equipped with only the in-cylinder fuel injection valves 125. In this modified structure, the processing of steps S210 to S240 is to be omitted from the start control routine of FIG. 3.

The hybrid vehicle 20 of the embodiment or any of the various modified examples executes the start control routine at a first start of the engine 22 after activation of the system. The start control routine may also be applied at a start of the engine 22 in the state of the lowered fuel pressure Pf in the delivery pipe 66.

The hybrid vehicle 20 of the embodiment or any of the various modified examples uses the electrically-operated high-pressure fuel pump 64 to pressurize the supply of fuel flowing through the delivery pipe 66. The supply of fuel flowing through the delivery pipe 66 may alternatively be pressurized by a mechanically-operated high-pressure fuel pump, which is actuated by rotation of the crankshaft 26 of the engine 22.

Figure 9:
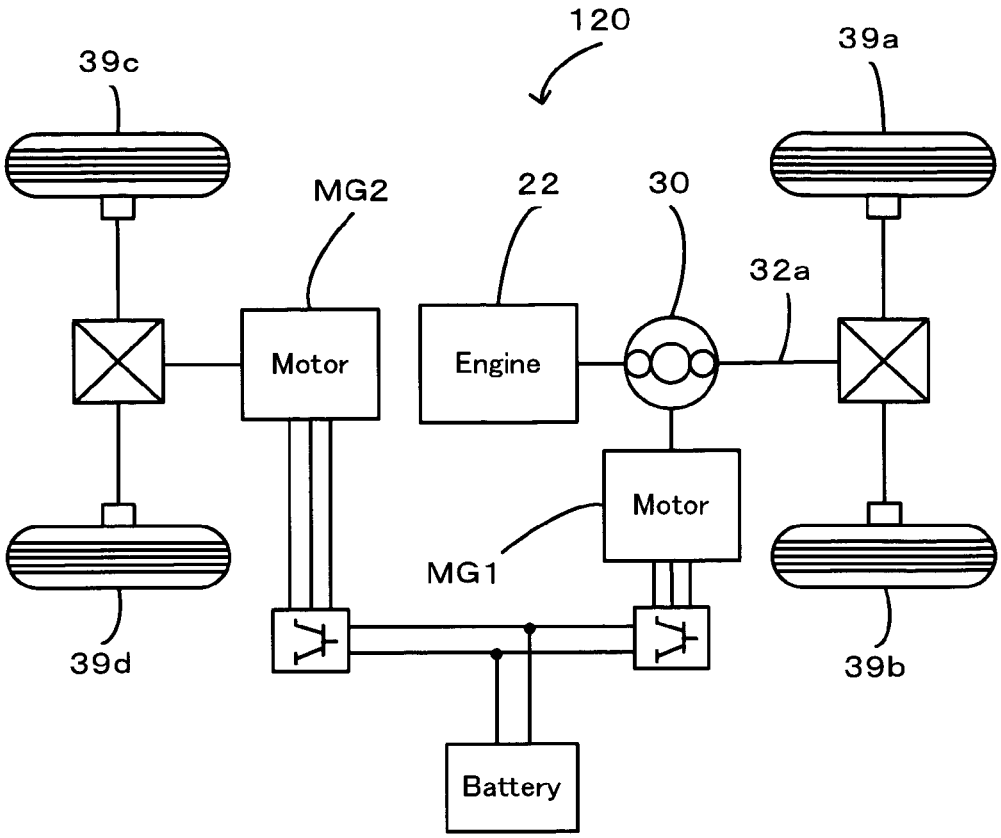
FIG. 9 schematically illustrates the structure of another hybrid vehicle in one modified example.
Figure 10:
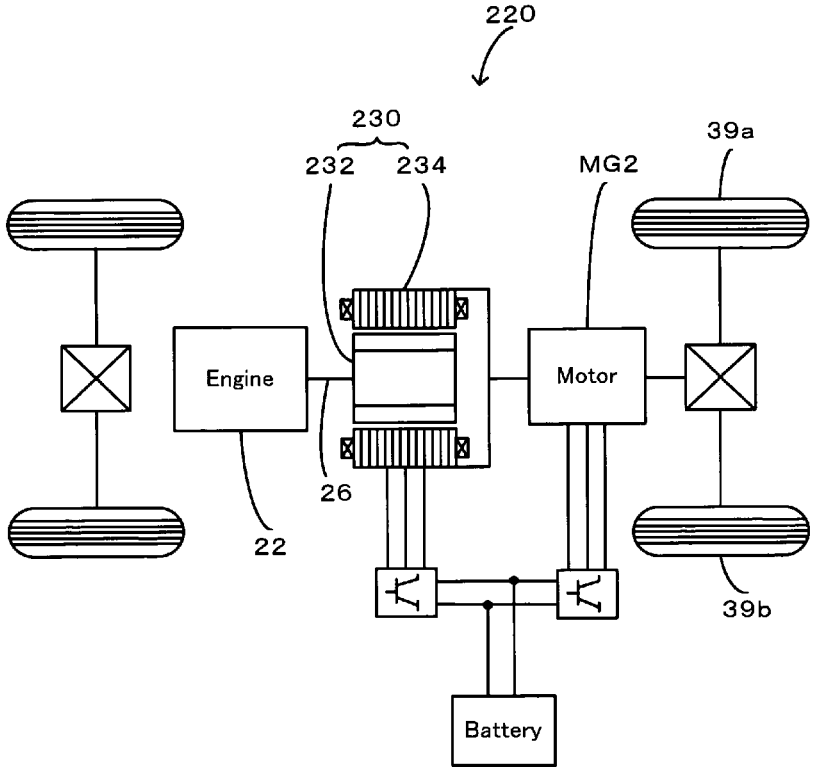
FIG. 10 schematically illustrates the structure of still another hybrid vehicle in another modified example.

In the hybrid vehicle 20 of the embodiment or any of the various modified examples, the power of the engine 22 is output via the power distribution integration mechanism 30 to the ring gear shaft 32*a* or the drive shaft linked to the drive wheels 39*a* and 39*b*. The technique of the invention is, however, not restricted to this configuration but may be adopted in a hybrid vehicle 120 of a modified configuration shown in FIG. 9, where the power of the motor MG2 is transmitted to a different axle (an axle linked to wheels 39*c* and 39*d*) from the axle connecting with the ring gear shaft 32*a* (the axle linked to the drive wheels 39*a* and 39*b*). The technique of the invention is also applicable to a hybrid vehicle 220 of another modified example as shown in FIG. 10. The hybrid vehicle 220 of this modified configuration includes a pair-rotor motor 230 that includes an inner rotor 232 linked to the crankshaft 26 of the engine 22 and an outer rotor 234 connected to the drive shaft to output power to the drive wheels 39*a* and 39*b*. The pair-rotor motor 230 transmits part of the output power of the engine 22 to the drive shaft, while converting residual part of the output power into electric power. The hybrid vehicle may have any of diverse configurations, as long as the engine 22 mounted on the hybrid vehicle is equipped with the in-cylinder fuel injection valves 125.

The embodiment and the modified examples discussed above regard the hybrid vehicle 20 having the engine 22 equipped with the in-cylinder fuel injection valves 125. The engine 22 with the in-cylinder fuel injection valves 125 is not restricted to the application of the hybrid vehicles, but may be mounted on conventional engine vehicles. The engine 22 with the in-cylinder fuel injection valves 125 may also be mounted on diverse moving bodies including various vehicles other than motor vehicles, trains, boats and ships, and aircraft, and may also be incorporated in various stationary devices and apparatuses other than the moving bodies.

The embodiment and its modifications discussed above are to be considered in all aspects as illustrative and not restrictive. There may be many other modifications, changes, and alterations without departing from the scope or spirit of the main characteristics of the present invention. All changes within the meaning and range of equivalency of the claims are intended to be embraced therein. The scope and spirit of the present invention are indicated by the appended claims, rather than by the foregoing description.

The disclose of Japanese Patent Application No. 2004-271848 filed Sep. 17, 2004 including specification, drawings and claims is incorporated herein by reference in its entirety.

What is claimed is:

1. An internal combustion engine system including an internal combustion engine that is equipped with an in-cylinder fuel injection valve for in-cylinder injection of a fuel, said internal combustion engine system comprising:

a pressurization supply unit that pressurizes the fuel and supplies the pressurized fuel to the in-cylinder fuel injection valve at a start of the internal combustion engine;

a fuel pressure measurement sensor that measures a pressure of the fuel supplied to the in-cylinder fuel injection valve;

an in-cylinder compression pressure detection estimation module that either detects or estimates an in-cylinder compression pressure as an in-cylinder pressure in a compression process of the internal combustion engine;

a cranking module that cranks the internal combustion engine; and a start control module that, in response to a start instruction of the internal combustion engine, controls the cranking module to crank the internal combustion engine, while controlling the in-cylinder fuel injection valve to start fuel injection from the in-cylinder fuel injection valve, after the fuel pressure measured by the fuel pressure measurement sensor reaches a preset first pressure, which is determined according to the in-cylinder compression pressure either detected or estimated by the in-cylinder compression pressure detection estimation module and a closed valve position-retaining pressure for keeping the in-cylinder fuel injection valve in a closed position.

2. An internal combustion engine system in accordance with claim 1, wherein said start control module is activated in response to a first start instruction of the internal combustion engine after activation of said internal combustion engine system.

3. An internal combustion engine system in accordance with claim 1, said internal combustion engine system further comprising:

an intake-system fuel injection valve that injects the fuel into an air intake system of the internal combustion engine, wherein said start control module regulates an amount of intake-system fuel injection to make the intake-system fuel injection valve start fuel injection, prior to a start of fuel injection from the in-cylinder fuel injection valve.

4. An internal combustion engine system in accordance with claim 1, said internal combustion engine system further comprising:

an open-close timing varying mechanism that varies an open-close timing of an intake valve of the internal combustion engine, wherein said start control module controls the open-close timing varying mechanism and the cranking module to set the open-close timing of the intake valve to a first timing for facilitating the cranking and to crank the internal combustion engine at the first timing set to the open-close timing, said start control module controlling the open-close timing varying mechanism to initiate a timing change that gradually varies the open-close timing of the intake valve to earlier timing than the first timing, after the measured fuel pressure reaches a preset second pressure that is not higher than the preset first pressure, which is determined according to the detected or estimated in-cylinder compression pressure and the closed valve position-retaining pressure of the in-cylinder fuel injection valve.

5. An internal combustion engine system in accordance with claim 1, wherein said start control module controls a throttle valve to decrease an amount of air intake to the internal combustion engine below a standard level of air intake, until the measured fuel pressure reaches a preset third pressure that is not higher than the preset first pressure, which is determined according to the detected or estimated in-cylinder compression pressure and the closed valve position-retaining pressure of the in-cylinder fuel injection valve, said start control module controlling the throttle valve to restore the amount of air intake to the internal combustion engine to the standard level of air intake after the measured fuel pressure reaches the preset third pressure.

6. An internal combustion engine system in accordance with claim 1, wherein said start control module controls the cranking module to crank the internal combustion engine with a preset driving force smaller than a standard level of driving force, until the measured fuel pressure reaches a preset fourth pressure that is not higher than the preset first pressure, which is determined according to the detected or estimated in-cylinder compression pressure and the closed valve position-retaining pressure of the in-cylinder fuel injection valve, said start control module controlling the cranking module to crank the internal combustion engine with the standard level of driving force after the measured fuel pressure reaches the preset fourth pressure.

7. An internal combustion engine system including an internal combustion engine that is equipped with an in-cylinder fuel injection valve for in-cylinder injection of a fuel, said internal combustion engine system comprising:

a pressurization supply unit that pressurizes the fuel and supplies the pressurized fuel to the in-cylinder fuel injection valve at a start of the internal combustion engine;

a fuel pressure measurement sensor that measures a pressure of the fuel supplied to the in-cylinder fuel injection valve;

an in-cylinder compression pressure detection estimation module that either detects or estimates an in-cylinder compression pressure as an in-cylinder pressure in a compression process of the internal combustion engine;

a cranking module that cranks the internal combustion engine;

an open-close timing varying mechanism that varies an open-close timing of an intake valve of the internal combustion engine; and a start control module that, in response to a start instruction of the internal combustion engine, controls the open-close timing varying mechanism and the cranking module to set the open-close timing of the intake valve to a first timing for facilitating the cranking and to crank the internal combustion engine at the first timing set to the open-close timing, said start control module controlling the open-close timing varying mechanism to initiate a timing change that gradually varies the open-close timing of the intake valve to earlier timing than the first timing, after the fuel pressure measured by the fuel pressure measurement sensor reaches an adaptive pressure, which is determined according to the in-cylinder compression pressure either detected or estimated by the in-cylinder compression pressure detection estimation module and a closed valve position-retaining pressure for keeping the in-cylinder fuel injection valve in a closed position, said start control module controlling the in-cylinder fuel injection valve to start fuel injection from the in-cylinder fuel injection valve at a preset timing.

8. An internal combustion engine system in accordance with claim 7, wherein the preset timing comes after the fuel pressure measured by the fuel pressure measurement sensor reaches a greater pressure than the adaptive pressure.

9. An internal combustion engine system including an internal combustion engine that is equipped with an in-cylinder fuel injection valve for in-cylinder injection of a fuel, said internal combustion engine system comprising:

a pressurization supply unit that pressurizes the fuel and supplies the pressurized fuel to the in-cylinder fuel injection valve at a start of the internal combustion engine;

a fuel pressure measurement sensor that measures a pressure of the fuel supplied to the in-cylinder fuel injection valve;

an in-cylinder compression pressure detection estimation module that either detects or estimates an in-cylinder compression pressure as an in-cylinder pressure in a compression process of the internal combustion engine;

a cranking module that cranks the internal combustion engine; and a start control module that, in response to a start instruction of the internal combustion engine, controls the cranking module to crank the internal combustion engine, said start control module controlling a throttle valve to decrease an amount of air intake to the internal combustion engine below a standard level of air intake, until the fuel pressure measured by the fuel pressure measurement sensor reaches an adaptive pressure, which is determined according to the in-cylinder compression pressure either detected or estimated by the in-cylinder compression pressure detection estimation module and a closed valve position-retaining pressure for keeping the in-cylinder fuel injection valve in a closed position, said start control module controlling the throttle valve to restore the amount of air intake to the internal combustion engine to the standard level of air intake after the measured fuel pressure reaches the adaptive pressure, said start control module controlling the in-cylinder fuel injection valve to start fuel injection from the in-cylinder fuel injection valve at a preset timing.

10. An internal combustion engine system in accordance with claim 9, wherein the preset timing comes after the fuel pressure measured by the fuel pressure measurement sensor reaches a greater pressure than the adaptive pressure.

11. An internal combustion engine system including an internal combustion engine that is equipped with an in-cylinder fuel injection valve for in-cylinder injection of a fuel, said internal combustion engine system comprising:

a pressurization supply unit that pressurizes the fuel and supplies the pressurized fuel to the in-cylinder fuel injection valve at a start of the internal combustion engine;

a fuel pressure measurement sensor that measures a pressure of the fuel supplied to the in-cylinder fuel injection valve;

an in-cylinder compression pressure detection estimation module that either detects or estimates an in-cylinder compression pressure as an in-cylinder pressure in a compression process of the internal combustion engine;

a cranking module that cranks the internal combustion engine; and a start control module that, in response to a start instruction of the internal combustion engine, controls the cranking module to crank the internal combustion engine with a preset first driving force, until the fuel pressure measured by the fuel pressure measurement sensor reaches an adaptive pressure, which is determined according to the in-cylinder compression pressure either detected or estimated by the in-cylinder compression pressure detection estimation module and a closed valve position-retaining pressure for keeping the in-cylinder fuel injection valve in a closed position, said start control module controlling the cranking module to crank the internal combustion engine with a greater driving force than the preset first driving force after the measured fuel pressure reaches the adaptive pressure, said start control module controlling the in-cylinder fuel injection valve to start fuel injection from the in-cylinder fuel injection valve at a preset timing.

12. An internal combustion engine system in accordance with claim 11, wherein the preset timing comes after the fuel pressure measured by the fuel pressure measurement sensor reaches a greater pressure than the adaptive pressure.

13. A starting method of an internal combustion engine in an internal combustion engine system, said internal combustion engine system comprising said internal combustion engine that is equipped with an in-cylinder fuel injection valve for in-cylinder injection of a fuel, a pressurization supply unit that pressurizes the fuel and supplies the pressurized fuel to the in-cylinder fuel injection valve at a start of the internal combustion engine, and a cranking module that cranks the internal combustion engine, said starting method comprising the steps of:

controlling the cranking module to crank the internal combustion engine; and controlling the in-cylinder fuel injection valve to start fuel injection from the in-cylinder fuel injection valve, after a pressure of the fuel supplied to the in-cylinder fuel injection valve reaches an adaptive pressure, which is determined according to an in-cylinder compression pressure as an in-cylinder pressure in a compression process of the internal combustion engine and a closed valve position-retaining pressure for keeping the in-cylinder fuel injection valve in a closed position.

14. A starting method of an internal combustion engine in an internal combustion engine system, said internal combustion engine system comprising said internal combustion engine that is equipped with an in-cylinder fuel injection valve for in-cylinder injection of a fuel, a pressurization supply unit that pressurizes the fuel and supplies the pressurized fuel to the in-cylinder fuel injection valve at a start of the internal combustion engine, a cranking module that cranks the internal combustion engine, and an open-close timing varying mechanism that varies an open-close timing of an intake valve of the internal combustion engine, said starting method comprising the steps of:

controlling the open-close timing varying mechanism and the cranking module to set the open-close timing of the intake valve to a first timing for facilitating the cranking and to crank the internal combustion engine at the first timing set to the open-close timing;

controlling the open-close timing varying mechanism to initiate a timing change that gradually varies the open-close timing of the intake valve to earlier timing than the first timing, after a pressure of the fuel supplied to the in-cylinder fuel injection valve reaches an adaptive pressure, which is determined according to an in-cylinder compression pressure as an in-cylinder pressure in a compression process of the internal combustion engine and a closed valve position-retaining pressure for keeping the in-cylinder fuel injection valve in a closed position; and controlling the in-cylinder fuel injection valve to start fuel injection from the in-cylinder fuel injection valve at a preset timing.

15. A starting method of an internal combustion engine in an internal combustion engine system, said internal combustion engine system comprising said internal combustion engine that is equipped with an in-cylinder fuel injection valve for in-cylinder injection of a fuel, a pressurization supply unit that pressurizes the fuel and supplies the pressurized fuel to the in-cylinder fuel injection valve at a start of the internal combustion engine, and a cranking module that cranks the internal combustion engine, said starting method comprising the steps of:

controlling the cranking module to crank the internal combustion engine;

controlling a throttle valve to decrease an amount of air intake to the internal combustion engine below a standard level of air intake, until a pressure of the fuel supplied to the in-cylinder fuel injection valve reaches an adaptive pressure, which is determined according to an in-cylinder compression pressure as an in-cylinder pressure in a compression process of the internal combustion engine and a closed valve position-retaining pressure for keeping the in-cylinder fuel injection valve in a closed position;

controlling the throttle valve to restore the amount of air intake to the internal combustion engine to the standard level of air intake after the fuel pressure reaches the adaptive pressure; and controlling the in-cylinder fuel injection valve to start fuel injection from the in-cylinder fuel injection valve at a preset timing.

16. A starting method of an internal combustion engine in an internal combustion engine system, said internal combustion engine system comprising said internal combustion engine that is equipped with an in-cylinder fuel injection valve for in-cylinder injection of a fuel, a pressurization supply unit that pressurizes the fuel and supplies the pressurized fuel to the in-cylinder fuel injection valve at a start of the internal combustion engine, and a cranking module that cranks the internal combustion engine, said starting method comprising the steps of:

controlling the cranking module to crank the internal combustion engine with a preset first driving force, until a pressure of the fuel supplied to the in-cylinder fuel injection valve reaches an adaptive pressure, which is determined according to an in-cylinder compression pressure as an in-cylinder pressure in a compression process of the internal combustion engine and a closed valve position-retaining pressure for keeping the in-cylinder fuel injection valve in a closed position;

controlling the cranking module to crank the internal combustion engine with a greater driving force than the preset first driving force after the fuel pressure reaches the adaptive pressure; and controlling the in-cylinder fuel injection valve to start fuel injection from the in-cylinder fuel injection valve at a preset timing.

* * * * *